US006212344B1

(12) United States Patent
Takagi et al.

(10) Patent No.: US 6,212,344 B1
(45) **Date of Patent: *Apr. 3, 2001**

(54) IMAGE FORMING APPARATUS WITH INTEGRALLY HOLDING IMAGE UNIT

(75) Inventors: Osamu Takagi, Tokyo; Yoshiya Hashimoto; Hiroshi Murata, both of Yokohama; Kazuhisa Kimura, Hiratsuka, all of (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/269,769

(22) PCT Filed: Aug. 10, 1998

(86) PCT No.: PCT/JP98/03553

§ 371 Date: Apr. 9, 1999

§ 102(e) Date: Apr. 9, 1999

(87) PCT Pub. No.: WO99/08160

PCT Pub. Date: Feb. 18, 1999

(30) Foreign Application Priority Data

| | | |
|---|---|---|
| Aug. 11, 1997 | (JP) | 9-216619 |
| Nov. 14, 1997 | (JP) | 9-313714 |
| Jun. 22, 1998 | (JP) | 10-174814 |

(51) Int. Cl.[7] ..... G03G 15/01

(52) U.S. Cl. ..... 399/112; 399/113

(58) Field of Search ..... 399/111, 223, 399/299, 298, 300, 303, 305, 112

(56) References Cited

U.S. PATENT DOCUMENTS

| | | | | |
|---|---|---|---|---|
| 5,014,094 | * | 5/1991 | Amitani et al. | 399/112 |
| 5,321,482 | * | 6/1994 | Yano et al. | 399/350 |
| 5,615,001 | * | 3/1997 | Kawashima et al. | 399/112 X |
| 5,740,493 | * | 4/1998 | Otaki et al. | 399/299 |
| 5,768,669 | | 6/1998 | Yokoyama | 399/282 |

FOREIGN PATENT DOCUMENTS

| | | | |
|---|---|---|---|
| 0 614 130 A2 | | 9/1994 | (EP) . |
| 63-4250 | * | 1/1988 | (JP) . |
| 9-222840 | | 8/1997 | (JP) . |
| 11-65194 | * | 3/1999 | (JP) . |

OTHER PUBLICATIONS

Patent Abstracts of Japan, vol. 095, No. 006, Jul. 31, 1995, & JP 07 064366 A, Mar. 10, 1995.

Patent Abstracts of Japan, vol. 096, No. 009, Sep. 30, 1996 & JP 08 123125 A, May 17, 1996.

* cited by examiner

*Primary Examiner*—Quana M. Grainger
(74) *Attorney, Agent, or Firm*—Foley & Lardner

(57) ABSTRACT

As an image forming apparatus of this invention, a color copying machine in which four image forming units are juxtaposed along the convey direction of a paper sheet is known. Each image forming unit has a photosensitive drum which is in rolling contact with a conveyor belt. Around the photosensitive drum, a charging device, exposure device, developing device, transfer device, cleaning device, and charge removing device are placed in turn along the rotation direction of the drum. An image unit is interposed between the photosensitive drum in the predetermined image forming unit, and the photosensitive drum in the image forming unit, which neighbors that image forming unit on its upstream side. The image unit integrally holds the developing device for developing an electrostatic latent image formed on the downstream photosensitive drum, and the cleaning device for cleaning the upstream photosensitive drum. Also, the image unit is detachably inserted between the two neighboring photosensitive drums.

7 Claims, 15 Drawing Sheets

IMAGE FORMING APPARATUS WITH INTEGRALLY HOLDING IMAGE UNIT

TECHNICAL FIELD

The present invention relates to an image forming apparatus in which a plurality of image forming means are juxtaposed along the convey direction of a transfer medium and, more particularly, to an image forming apparatus such as an electrophotographic color copying machine, color printer, or the like, in which four image forming units for respectively outputting four color images are juxtaposed.

BACKGROUND ART

FIG. 27 schematically shows the arrangement of a color copying machine as a conventional image forming apparatus, in which image forming units Ya to Yd (image forming means) for four colors are juxtaposed along the convey direction of a paper sheet P (transfer medium).

The image forming units Ya to Yd respectively comprise photosensitive drums 1*a* to 1*d* serving as image carriers. A conveyor belt T nearly horizontally extends below the photosensitive drums 1*a* to 1*d*. Charging devices 2*a* to 2*d*, exposure devices 3*a* to 3*d*, developing devices 4*a* to 4*d*, transfer devices 5*a* to 5*d*, cleaning devices 6*a* to 6*d*, and charge removing devices 7*a* to 7*d* are disposed around the corresponding photosensitive drums along the rotation direction of the drum. Note that the transfer devices 5*a* to 5*d* are disposed on the back surface side of the conveyor belt T.

The image forming unit Ya which is located on the most upstream side along the convey direction of the paper sheet P outputs a yellow image, the second image forming unit Yb a magenta image, the third image forming unit Yc a cyan image, and the last image forming unit Yd a black image.

When a color image is formed on a paper sheet P by the color copying machine with the above-mentioned arrangement, the paper sheet P is conveyed by the conveyor belt T, and image forming processes are done in the order of charging, exposure, development, transfer, cleaning, and charge removal for the surfaces of the photosensitive drums 1*a* to 1*d* in the image forming units Ya to Yd. Color developing agent images formed by the individual image forming units Ya to Yd are transferred onto the paper sheet P to overlap each other. The paper sheet P on which the color developing agent images are transferred to overlap each other passes through a fixing device (not shown) which neighbors the fourth image forming unit Yd on its downstream side, and the color developing agent images are melted and fixed on the paper sheet P there, thus forming a color image on the paper sheet P.

However, the conventional color copying machine is constructed by serially disposing four image forming units, each of which constructs a so-called monochrome copying machine for forming a monochrome image, along the convey direction of the paper sheet P.

More specifically, the cleaning devices 6*a* to 6*c* except for the cleaning device 6*d* of the fourth image forming unit Yd, and developing devices 4*b* to 4*d* except for the developing device 4*a* of the first image forming unit Ya are interposed between the neighboring photosensitive drums 1*a* to 1*d*. Since the cleaning devices 6*a* to 6*c* and developing devices 4*b* to 4*d* have predetermined volumes, minimum required spaces must be assured between the neighboring photosensitive drums to attach the devices 4 and 6 between the neighboring photosensitive drums 1*a* to 1*d* and to adjust the attachment positions of the devices 4 and 6.

Hence, in the aforementioned conventional color copying machine, given spaces are required between the neighboring photosensitive drums 1*a* to 1*d*, and the size of the entire apparatus along the line-up direction of the photosensitive drums 1*a* to 1*d* (longitudinal direction), i.e., the convey direction of the paper sheet P, becomes large.

In addition, in the color copying machine, since the individual color image forming units Ya to Yd are used nonuniformly, they must independently undergo exchange, adjustment, and maintenance. For this purpose, a structure that can insert/remove each unit into/from the copying machine independently is required, thus disturbing a size reduction of the apparatus.

In order to attain a size reduction of the apparatus, the photosensitive performance of the photosensitive drums 1*a* to 1*d* must be improved. When the process speed is increased to process a large number of paper sheets P within a short period of time in consideration of the photosensitive performance, the exposure-development distance becomes insufficient, and a size reduction is limited in consideration of the sheet convey portion. For example, the exposure-development processing time normally requires 0.15 sec, and it is impossible to reduce the diameter of the photosensitive drum to be smaller than the current diameter.

As a consequence, in order to shorten the size of a color copying machine of this type along the longitudinal direction, it is effective to reduce the pitch between the neighboring photosensitive drums 1*a* to 1*d*. For this purpose, size reductions of the developing devices 4*b* to 4*d* and cleaning devices 6*a* to 6*c* interposed between the neighboring photosensitive drums 1*a* to 1*d* need only be promoted.

In the conventional color copying machine, each of the image forming units Ya to Yd has many constituent devices (the photosensitive drum 1, charging device 2, exposure device 3, developing device 4, transfer device 5, cleaning device, and charge removing device 7 will be generally referred to as constituent devices hereinafter), and four sets of these constituent devices must be equipped. For this reason, it is troublesome to manufacture and manage the devices that make up each unit, thus adversely influencing the manufacturing cost. In the image forming units Ya to Yd, since the constituent devices arranged around their photosensitive drums 1*a* to 1*d* must be independently and accurately aligned with respect to the photosensitive drums, many manufacturing processes are required, and assembly of the copying machine requires much labor.

DISCLOSURE OF INVENTION

The present invention has been made in consideration of the above situation, and has as its object to provide an image forming apparatus in which a plurality of image forming means are juxtaposed along the convey direction of a transfer medium, and which can reduce the size of the apparatus along the line-up direction of the image forming means.

It is another object of the present invention to provide an image forming apparatus which can reduce the number of manufacturing processes required for assembling the apparatus, and labor that pertains to the manufacture and management of constituent devices, and can reduce the manufacturing cost of the apparatus.

In order to achieve the above objects, an image forming apparatus of claim 1 in the present invention comprises:

- convey means for conveying a transfer medium in a predetermined direction;
- a first image carrier which is free to rotate along a convey direction of the transfer medium;

a second image carrier which is free to rotate along the convey direction and is spaced from the first image carrier on the downstream side in the convey direction;

first and second latent image forming means for respectively forming latent images on the first and second image carriers;

first and second developing means for developing the latent images respectively formed on the first and second image carriers by the first and second latent image forming means by supplying developing agents;

first and second transfer means for sequentially transferring the developing agent images developed by the first and second developing means onto the transfer medium conveyed by the convey means;

first and second removing means for respectively removing residual developing agents which remain on the first and second image carriers without being transferred onto the transfer medium by the first and second transfer means; and holding means for integrally holding the first removing means for removing the residual developing agent on the first image carrier, and the second developing means for developing the latent image formed on the second image carrier by supplying the developing agent.

An image forming apparatus of claim 2 in the present invention comprises:

convey means for conveying a transfer medium in a predetermined direction;

a first image carrier which is free to rotate along a convey direction of the transfer medium;

a second image carrier which is free to rotate along the convey direction and is spaced from the first image carrier on the downstream side in the convey direction;

first and second latent image forming means for respectively forming latent images on the first and second image carriers;

first and second developing means for developing the latent images respectively formed on the first and second image carriers by the first and second latent image forming means by supplying developing agents;

first and second transfer means for sequentially transferring the developing agent images developed by the first and second developing means onto the transfer medium conveyed by the convey means;

first and second scraper means for respectively scraping off residual developing agents which remain on the first and second image carriers without being transferred onto the transfer medium by the first and second transfer means;

first and second recovery means for recovering the developing agents scraped off by the first and second scraper means; and holding means for integrally holding the first recovery means for recovering the developing agent removed from the first image carrier by the first scraper means, and the second developing means for developing the latent image formed on the second image carrier by supplying the developing agent.

According to an image unit of claim 3 in the present invention, there is provided an image unit detachably attached to an image forming apparatus, in which a plurality of image forming means, each of which has an image carrier that rotates along a convey direction of a transfer medium conveyed in a predetermined direction, electrostatic latent image forming means for forming an electrostatic latent image on a circumferential surface of the image carrier, a developing device for developing the electrostatic latent image by supplying a developing agent, a transfer device for transferring the developing agent image developed by the developing device onto the transfer medium conveyed in the predetermined direction, and a cleaning device for cleaning the residual developing agent which remains on the circumferential surface of the image carrier without being transferred by the transfer device, are juxtaposed in the convey direction, and which forms an image by sequentially transferring developing agent images formed by the individual image forming means onto the transfer medium conveyed via these image forming means, wherein the image unit integrates the developing device in the predetermined image forming means, and the cleaning device in the image forming means which neighbors the predetermined image forming means on an upstream side thereof.

According to an image unit of claim 4 in the present invention, there is provided an image unit detachably attached to an image forming apparatus, in which a plurality of image forming means, each of which has an image carrier that rotates along a convey direction of a transfer medium conveyed in a predetermined direction, electrostatic latent image forming means for forming an electrostatic latent image on a circumferential surface of the image carrier, a developing device for developing the electrostatic latent image by supplying a developing agent, a transfer device for transferring the developing agent image developed by the developing device onto the transfer medium conveyed in the predetermined direction, and a cleaning device including a blade for scraping off the residual developing agent which remains on the circumferential surface of the image carrier without being transferred by the transfer device, and a recovery portion for recovering the scraped developing agent, are juxtaposed in the convey direction, and which forms an image by sequentially transferring developing agent images formed by the individual image forming means onto the transfer medium conveyed via these image forming means, wherein the image unit integrates the developing device in the predetermined image forming means, and the recovery portion of the cleaning device in the image forming means which neighbors the predetermined image forming means on an upstream side thereof.

BEST MODE OF CARRYING OUT THE INVENTION

The preferred embodiments of the present invention will now be described with reference to the accompanying drawings.

Figure 1:
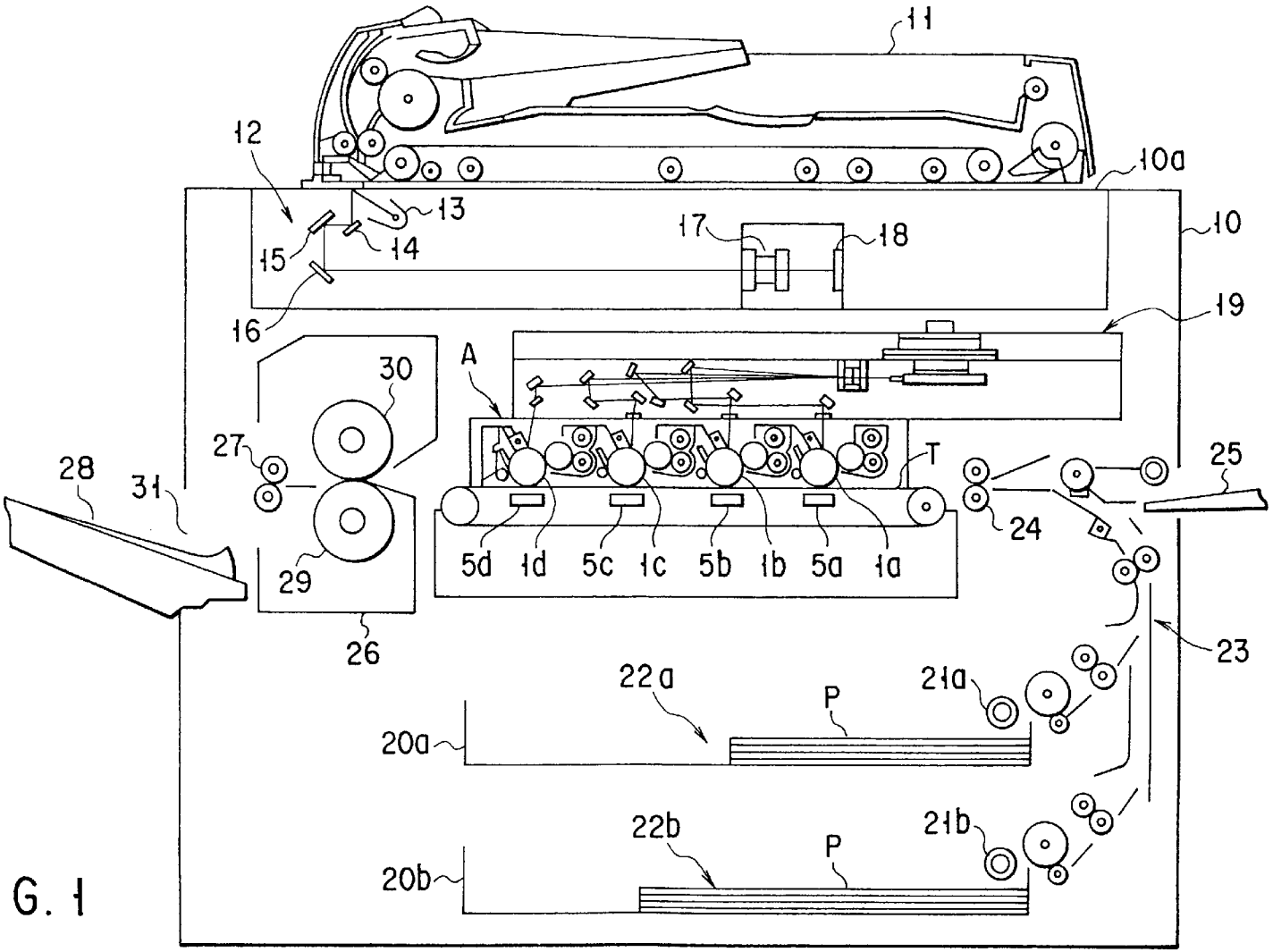
FIG. 1 is a schematic sectional view showing the internal structure of a color copying machine according to an embodiment of the present invention.

FIG. 1 schematically shows the internal arrangement of a quadruple, tandem color copying machine as an image forming apparatus according to the present invention.

This color copying machine has an apparatus main body 10. An original table 10*a* formed of a transparent glass plate is fitted into the upper surface of the apparatus main body 10. An automatic document feeder 11 (to be referred to as an ADF 11 hereinafter) for automatically feeding a stack of originals onto the original table 10*a* one by one is placed above the original table 10*a*. The ADF 11 is free to open/close with respect to the original table 10*a*, and also serves as an original pressing plate for pressing an original set on the original table 10*a*.

A scanner module 12 is arranged beneath the original table 10*a* in the apparatus main body 10. The scanner module 12 illuminates an original fed onto the original table 10*a* from the rear surface side of the original table 10*a*, receives light reflected by the original, and captures image information based on the reflected light. The scanner module 12 comprises a plurality of carriages (not shown) which are moved along the original table 10*a*. These carriages mount an exposure lamp 13 for irradiating light onto an original, a first reflection mirror 14 for reflecting light reflected by the original, and second and third mirrors 15 and 16 for reflecting the light reflected by the reflection mirror 14 and guiding it in a predetermined direction. An optical lens 17 and photoelectric conversion element 18 are disposed in turn on the optical path of the light reflected by the third reflection mirror 16.

The apparatus main body 10 also comprises a laser unit 19 (exposure device) which includes a plurality of laser emission devices for respectively emitting laser beams corresponding to image information in units of colors, and a polygonal mirror. The image information for each color is acquired via the scanner module 12, or is input from an external apparatus (not shown). A laser beam for each color emitted by the laser unit 19 is guided to a corresponding one of four photosensitive drums 1*a* to 1*d* as image carriers, which are rotatably disposed at nearly the center in the apparatus main body 10, via the rotating polygonal mirror and a plurality of optical elements. At this time, the circumferential surface of each photosensitive drum (to be simply referred to as a drum surface hereinafter) is scanned by the corresponding laser beam, and an electrostatic latent image for each color is formed on the drum surface.

Around each of the photosensitive drums 1*a* to 1*d*, a plurality of constituent devices (to be described later) are disposed together with the above-mentioned laser unit 19, and these constituent devices construct a plurality of image forming units (image forming means). The image forming units for four colors are juxtaposed to form an image forming module A. Note that image forming module A will be described in detail later by presenting a plurality of embodiments A1 to A14.

A conveyor belt T for conveying a paper sheet P as a transfer medium along the drum surfaces is arranged below the photosensitive drums 1*a* to id. The conveyor belt T is looped between a pair of rollers and extends nearly horizontally to travel endlessly. On the inner side of the conveyor belt T, i.e., on the rear surface side of the belt opposing the photosensitive drums 1*a* to 1*d*, transfer devices 5*a* to 5*d* that construct the corresponding image forming units are placed.

Two paper cassettes 20*a* and 20*b* which store a plurality of paper sheets P with different sizes are located on the bottom portion of the apparatus main body 10. Pickup rollers 21*a* and 21*b*, which are in rolling contact with the uppermost paper sheets P of those stored in these paper cassettes 20*a* and 20*b*, are placed at the end portions of the paper cassettes

20*a* and 20*b*. These paper cassettes 20*a* and 20*b* and pickup rollers 21*a* and 21*b* constitute paper feed devices 22*a* and 22*b*.

A paper convey device 23 is disposed at the paper feed side of the paper feed devices 22*a* and 22*b*. The paper convey device 23 conveys a paper sheet P picked up by the pickup roller 21*a* or 21*b* toward a pair of registration rollers 24 located in front of the conveyor belt T. A manual insertion paper feed module 25 which merges the paper convey device 23 at a position in front of the pair of registration rollers 24 is set on the right side surface (FIG. 1) of the apparatus main body 10.

A fixing device 26, a pair of feed rollers 27, and an exhaust tray 28 are disposed in turn on the paper exit side that neighbors the left side (FIG. 1) of the conveyor belt T. The fixing device 26 has a heat roller 29 and a press roller 30 which is in press contact with the heat roller 29. A paper sheet P supplied between these rollers 29 and 30 is pressed at a predetermined pressure and is heated to a predetermined temperature. The exhaust tray 28 opposes an exhaust port 31 which is open to the left side surface (FIG. 1) of the apparatus main body 10, and is attached outside the apparatus main body 10.

Figure 2:
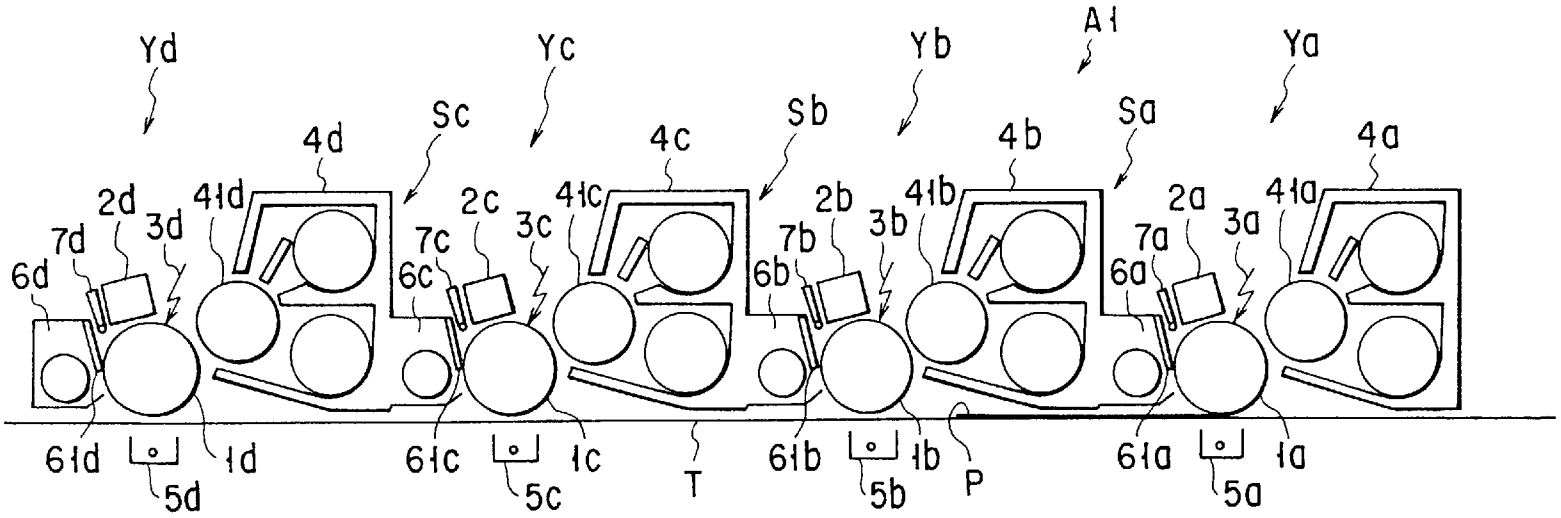
FIG. 2 is a schematic view showing the arrangement of an image forming module A1 according to the first embodiment of the present invention, which is built in the color copying machine shown in FIG. 1.

FIG. 2 shows an image forming module A1 according to the first embodiment of the present invention in an enlarged scale.

In this image forming module A1, a plurality of constituent devices 2 to 7 that construct corresponding image forming units Ya to Yd are disposed around the photosensitive drums 1*a* to 1*d*. More specifically, around the photosensitive drums 1*a* to 1*d*, charging devices 2*a* to 2*d* for uniformly charging the corresponding drum surfaces, developing devices 4*a* to 4*d* for developing electrostatic latent images formed on the corresponding drum surfaces via the above-mentioned laser unit 19 by supplying corresponding color developing agents (to be referred to as toners hereinafter) to them, transfer devices 5*a* to 5*d* for transferring the toner images (developing agent images) formed on the drum surfaces onto a paper sheet P, cleaning devices 6*a* to 6*d* for removing residual toners that remain on the drum surfaces without being transferred, and charge removing devices 7*a* to 7*d* for removing residual potential on the drum surfaces by uniformly irradiating light, after the residual toners have been removed by the cleaning devices, are disposed in turn along the rotation direction of the photosensitive drums. In FIG. 2, for the sake of illustrative simplicity, laser beams for the respective colors, which are irradiated onto the drum surfaces via the laser unit 19 as an exposure device for forming electrostatic latent images on the photosensitive drums la to 1*d* in the image forming units Ya to Yd, are denoted by reference numerals 3*a* to 3*d*.

The image forming units Ya to Yd are juxtaposed at a predetermined pitch from the upstream side (right side in FIG. 2) toward the downstream side (left side in FIG. 2) along the convey direction of the paper sheet P by the conveyor belt T. The developing device 4*a* in the most upstream side image forming unit Ya stores yellow toner, the developing device 4*b* in the second image forming unit Yb stores magenta toner, the developing device 4*c* in the third image forming unit Yc stores cyan toner, and the developing device 4*d* in the most downstream side image forming unit Yd stores black toner. More specifically, the image forming units Ya to Yd are placed in the order of colors with higher use frequencies along the convey direction of the paper sheet P.

In the present invention, in order to shorten the total length of the color copying machine along the line-up direction of the image forming units Ya to Yd, i.e., the convey direction of the paper sheet P (to be simply referred to as a longitudinal direction hereinafter), the constituent devices of two neighboring image forming units are integrally held as a unit.

Embodiments A1 to A14 for forming a plurality of constituent devices as units in the image forming module A will be explained hereinafter. Since the arrangements of the respective embodiments are roughly the same, the same reference numerals denote the constituent devices having similar functions, and a detailed description thereof will be omitted.

Figure 3:
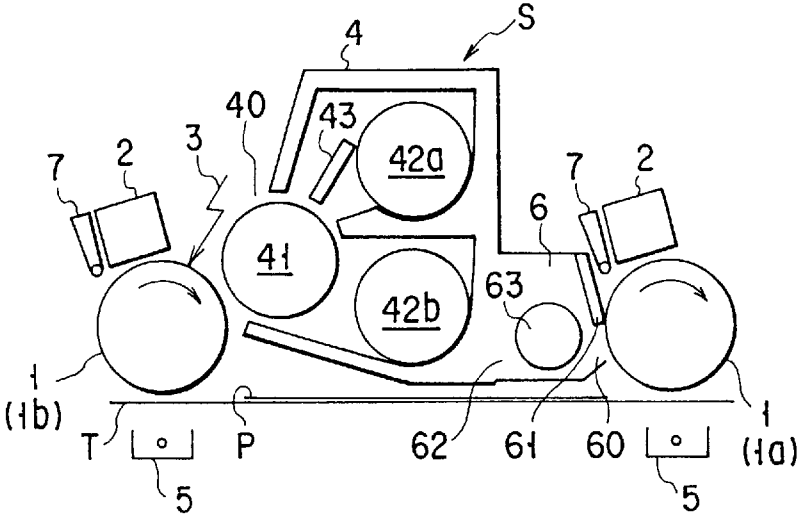
FIG. 3 is a schematic view showing an image unit attached to the image forming module show in FIG. 2.

FIG. 3 shows an image unit S built in the image forming module A1 according to the first embodiment described above. The image unit S integrally holds the developing device 4 and cleaning device 6 placed between two neighboring photosensitive drums 1. The image unit S is detachably inserted into the space between the two photosensitive drums 1.

The developing device 4 integrated as the image unit S has an opening 40 on a portion opposing the downstream photosensitive drum 1. In this opening 40, a magnet roller 41 for supplying toner onto that drum surface is rotatably arranged to oppose the drum surface with a given spacing. The developing device 4 also has a pair of vertically juxtaposed augers 42*a* and 42*b* for stirring and transferring toner stored in the device. Furthermore, the developing device 4 has a blade 43 which has a distal end that opposes the magnet roller 41 with a given spacing, and this blade 43 controls the thickness of the toner layer that becomes attached to the circumferential surface of the magnet roller 41.

On the other hand, the cleaning device 6 integrated in this image unit S has an opening 60 on a portion facing the upstream photosensitive drum 1. In this opening 60, a blade 61 as a scraping means for scraping off residual toner on the drum surface is disposed. The distal end of this blade 61 is elastically pressed against the drum surface at a given pressure. The cleaning device 6 comprises a recovery portion 62 for recovering toner scraped off by the blade 61, and an auger 63 for transferring the toner recovered in the recovery portion 62 in a predetermined direction.

The image unit S with the aforementioned arrangement is built in two neighboring photosensitive drums 1 in the image forming module A1 shown in FIG. 2. That is, a first image unit Sa is inserted between the first and second photosensitive drums 1*a* and 1*b*, a second image unit Sb between the second and third photosensitive drums 1*b* and 1*c*, and a third image unit Sc between the third and fourth photosensitive drums 1*c* and 1*d*.

Hence, the cleaning device 6*a* of the first image unit Sa cleans the first photosensitive drum 1*a*, and the developing device 4*b* of that same unit Sa develops an electrostatic latent image on the second photosensitive drum 1*b*. Likewise, the cleaning device 6*b* of the second image unit Sb cleans the second photosensitive drum 1*b*, and the developing device 4*c* of that unit Sb develops an electrostatic latent image on the third photosensitive drum 1*c*. Furthermore, the cleaning device 6*c* of the third image unit Sc cleans the third photosensitive drum 1*c*, and the developing device 4*d* of that unit Sc develops an electrostatic latent image on the fourth photosensitive drum 1*d*.

As described above, the image units Sa to Sc are constructed by integrally arranging the developing units 4*b* to 4*d* for developing electrostatic latent images formed on the photosensitive drums 1*b* to 1*d* in the image forming units of given colors, and the cleaning devices 6*a* to 6*c* for cleaning the photosensitive drums 1*a* to 1*c* in the upstream neighboring image forming units.

In the image forming module A1, the developing unit 4*a* in the image forming unit Ya for the first color and the cleaning device 6*d* in the image forming unit Yd for the fourth color are mounted solely, as in the conventional apparatus.

Image formation by the color copying machine with the image forming module A1 with the above-mentioned arrangement will be explained below.

An original is set on the original table 10*a*, and a copy start button (not shown) is turned on via a control panel (not shown). With this operation, the exposure lamp 13 is turned on and the carriages move in predetermined directions to illuminate the original set on the original table 10*a* from its rear surface side. Light reflected by the original is input to the photoelectric conversion element 18 via the first to third reflection mirrors 14 to 16 and optical lens 17.

Based on image information photoelectrically converted by the photoelectric conversion element 18, laser beams corresponding to the individual colors are emitted via the laser unit 19, and electrostatic latent images in units of colors are formed on the drum surfaces of the photosensitive drums 1*a* to 1*d* upon scanning by the polygonal mirror.

For example, an electrostatic latent image formed on the drum surface of the photosensitive drum 1*a* is developed by the developing device 4*a*. As a result, a yellow toner image is formed on the drum surface. On the other hand, a paper sheet P picked up from the paper cassette 20*a* or 20*b* is conveyed by the conveyor belt T, and is fed to a transfer position opposing the transfer device 5*a*. The yellow toner image formed on the drum surface is moved to the transfer position, and is transferred onto the paper sheet P.

The paper sheet P that bears the transferred yellow toner image is further conveyed by the conveyor belt T, and passes a transfer position opposing the transfer device 5*b*. At this position, a magenta toner image formed on the drum surface of the photosensitive drum 1*b* is transferred onto the paper sheet P to be superposed on the yellow toner image. That is, the magenta toner image is transferred to be superposed on the yellow toner image transferred onto the paper sheet P by the yellow image forming unit Ya.

Similarly, the paper sheet P passes the transfer devices 5*c* and 5*d*, and cyan and black toner images are transferred in turn to overlap the already transferred two-color toner images.

In this way, the paper sheet P on which the color toner images are transferred to overlap each other is conveyed to the fixing device 26. In the fixing device 26, the toner images are melted and fixed onto the paper sheet P, thus forming a color image. The paper sheet P on which the toner image is fixed is exhausted in turn onto the exhaust tray 28.

On the other hand, residual toner that remains on the drum surfaces of the photosensitive drums 1*a* to 1*d* without being transferred onto the paper sheet P is scraped out by the blades 61*a* to 61*d* of the corresponding cleaning devices 6*a* to 6*d*, and is recovered by the recovery portions 62*a* to 62*d*. Also, the residual potentials on the drum surfaces are removed by uniform light irradiation by the charge removing devices 7*a* to 7*d*. The surfaces of the charge-removed photosensitive drums 1*a* to 1*d* are uniformly charged via the charging devices 2*a* to 2*d* again to repeat the above-mentioned processes.

As described above, according to the first embodiment of the present invention, the image forming module A1 comprises the first to third image units Sa to Sc obtained by integrating the developing devices 4*b* to 4*d* interposed between the neighboring photosensitive drums 1*a* to 1*d*, and the upstream neighboring cleaning devices 6*a* to 6*c* each for the immediately preceding color.

Figure 27:
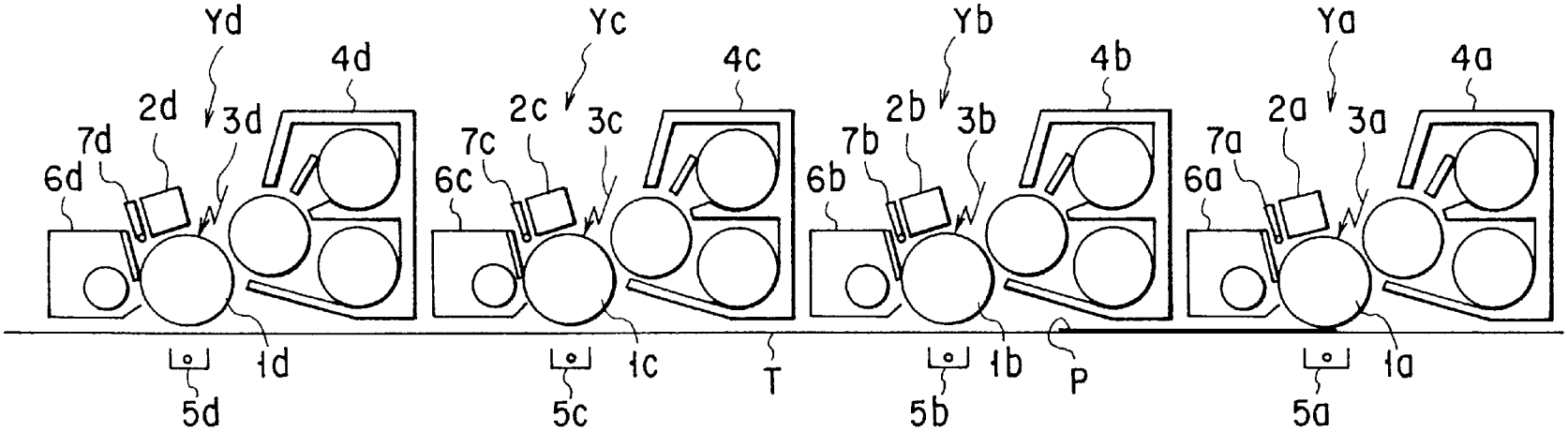
FIG. 27 PRIOR ART
FIG. 27 is a schematic view showing the arrangement of a conventional image forming module.

Hence, the developing device 4 and cleaning device 6 integrated in each of the image units Sa to Sc do not require extra frames therebetween. In addition, spacings required for adjustment upon attaching the constituent devices 4 and 6 to the copying machine can be removed. As a result, the size of the image forming module A1 in its longitudinal direction can be greatly shortened, and the entire color copying machine can be rendered compact. More specifically, as compared to the conventional image forming module (FIG. 27) in which four monochrome image forming units are juxtaposed, the unit for each color can be shortened by around 6 mm, and the module for a total of four colors can be shortened by about 20 mm.

Using the above-mentioned image unit S, at least the developing device 4 and cleaning device 6 need not be independently built in the copying machine, and the number of processes required for assembling the copying machine can be reduced. Furthermore, since the image unit S is used, labor required for managing the individual constituent devices that construct the image forming module A1 can be eliminated, and consequently, the manufacturing cost of the apparatus can be reduced.

In order to form a high-quality image by the aforementioned color copying machine, the spacings between the photosensitive drums 1*a* to 1*d* and magnet rollers 41*a* to 41*d* of the developing devices 4*a* to 4*d* must be accurately adjusted upon assembling the constituent devices of the individual image forming units Ya to Yd.

For this purpose, in the present invention, the developing devices 4 are accurately aligned to the corresponding photosensitive drums 1 using the image units Sa to Sc of the first embodiment described above. In other words, when the image unit S of this embodiment is used, the position of the developing device 4 with respect to the corresponding photosensitive drum 1 can be accurately set to fall within a designated value range upon assembly.

However, the developing device 4 integrally held by each image unit S can be accurately aligned to the photosensitive drum 1, but the cleaning device 6 integrally held by the image unit S cannot be accurately aligned to the photosensitive drum 1 facing it on its upstream side. That is, the mounting position of the cleaning device 6 with respect to each photosensitive drum 1 varies.

For this reason, in this embodiment, the blade 61 of each cleaning device 6 is pressed against the corresponding drum surface at a predetermined pressure. For example, the blade 61 is elastically biased against the drum surface using a spring member (not shown).

Figure 4:
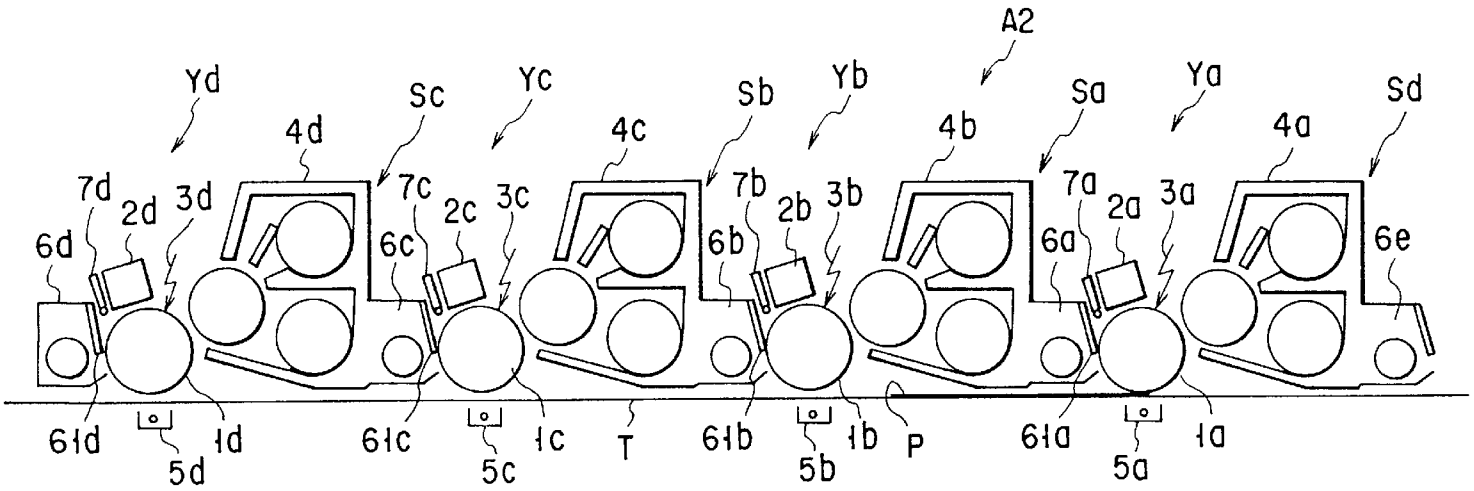
FIG. 4 is a schematic view showing the arrangement of an image forming module A2 according to the second embodiment of the present invention.

FIG. 4 schematically shows the arrangement of an image forming module A2 according to the second embodiment of the present invention.

The image forming module A2 comprises first to third image units Sa to Sc between neighboring photosensitive drums, as in the above-mentioned first embodiment. Also, the image forming module A2 comprises a fourth image unit Sd on the upstream side of the first photosensitive drum 1*a*. Note that a cleaning device 6*d* for cleaning a fourth photosensitive drum 1*d* is mounted solely as in the first embodiment.

In the fourth image unit Sd, a developing device 4*a* alone performs predetermined operation for the first photosensitive drum 1*a*, but a cleaning device 6*e* integrally held by this image unit Sd does not perform any operation for the photosensitive drum 1*a*. Hence, the cleaning device 6*e* equipped in the fourth image unit Sd is an extra one. However, the developing device 4*a* for the photosensitive drum 1*a* of the first color need not be mounted solely unlike in the first embodiment, and the image unit Sd can replace this portion.

For this reason, according to this embodiment, the same effect as in the first embodiment can be provided. Also, as compared to the first embodiment, since the first developing device 4*a* need not be mounted solely, the number of types of members that construct the image forming module can be reduced, and labor required for managing such members can be eliminated, thus contributing to a great cost reduction.

Figure 5:
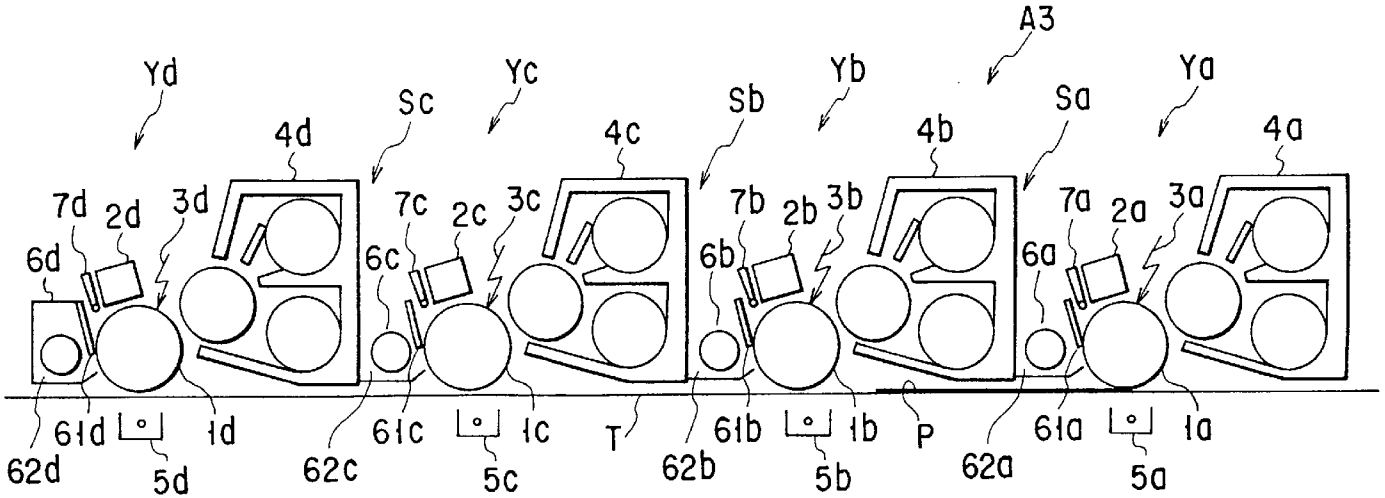
FIG. 5 is a schematic view showing the arrangement of an image forming module A3 according to the third embodiment of the present invention.

FIG. 5 schematically shows the arrangement of an image forming module A3 according to the third embodiment of the present invention.

This image forming module A3 comprises first to third image units Sa to Sc between neighboring photosensitive drums, as in the first and second embodiments described above. Each of the image units Sa to Sc of this embodiment integrally holds a developing device 4 in a predetermined image forming unit, and a recovery portion 62 of a cleaning device 6 in the upstream neighboring image forming unit. That is, in blades 61*a* to 61*c* of cleaning devices 6*a* to 6*c* in first to third image forming units Ya to Yc solely face the corresponding photosensitive drums. In this embodiment as well, a developing device 4*a* for developing an electrostatic latent image on a first photosensitive drum 1*a*, and a cleaning device 6*d* for cleaning a fourth photosensitive drum 1*d* are mounted solely as in the first embodiment described above.

Figure 6:
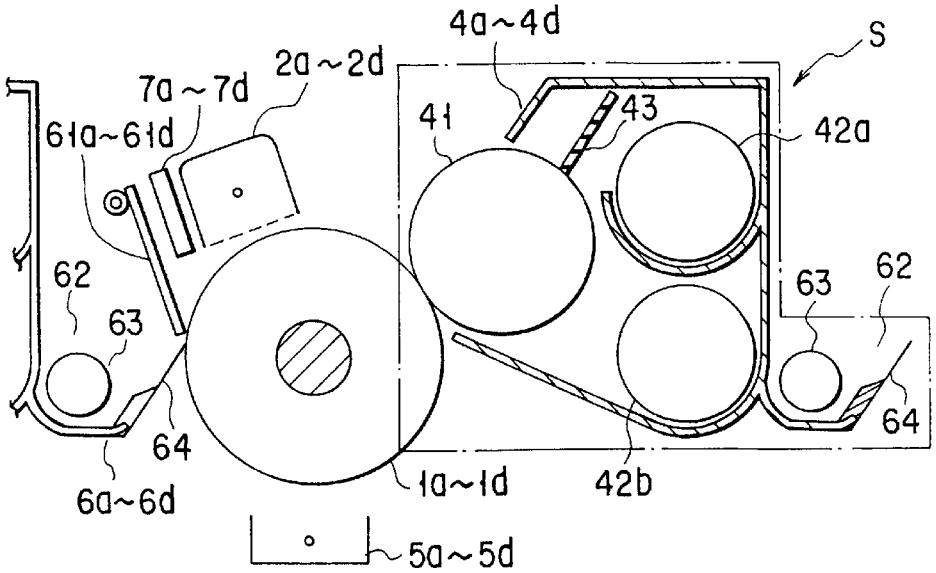
FIG. 6 is a schematic view showing an image unit attached to the image forming module shown in FIG. 5.

FIG. 6 shows the image unit S built in the image forming module A3 according to the third embodiment described above in an enlarged scale. This image unit S is detachably inserted into the space between the two photosensitive drums 1.

The developing device 4 integrally held by the image unit S has a magnet roller 41 for supplying toner onto the drum surface, a pair of vertically juxtaposed augers 42*a* and 42*b* for stirring and transferring toner stored in the developing device 4, and a blade 43 having a distal end which opposes the magnet roller 41 with a predetermined spacing.

In the recovery portion 62 of the cleaning device integrally held by the image unit S, an auger 63 for transferring recovered toner in a predetermined direction is disposed. Also, the recovery portion 62 has a recovering plate 64 for receiving toner scraped off by the blade 61 mounted independently of the image unit S. The distal end of this recovering plate 64 projects to a position in the vicinity of the drum surface of the opposing photosensitive drum.

Figure 7:
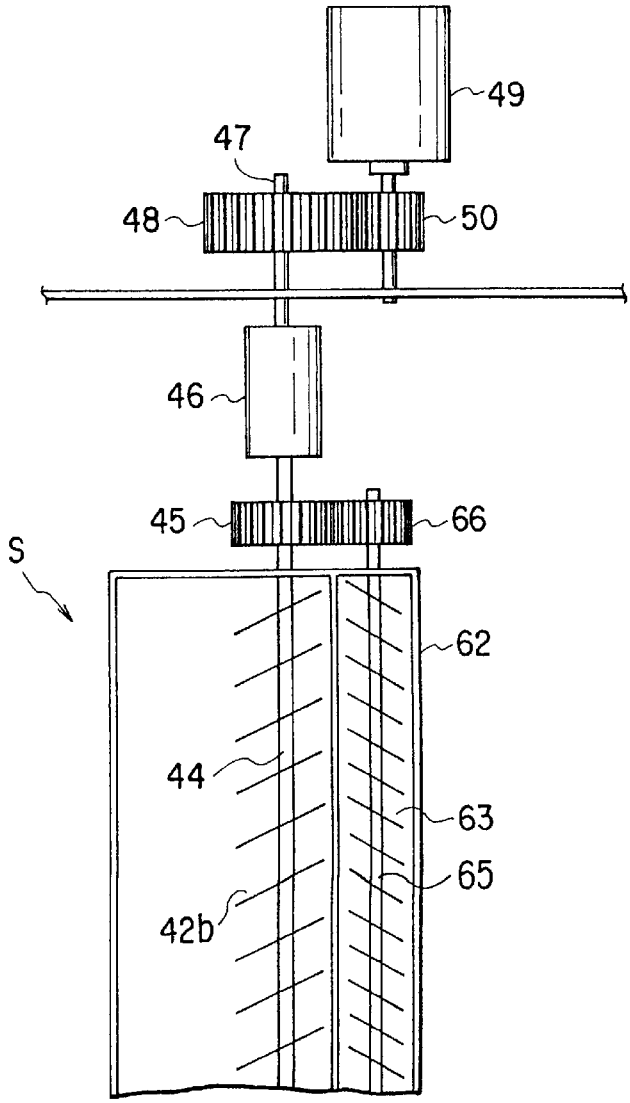
FIG. 7 is a schematic view showing a driving system in the image unit shown in FIG. 6.

As shown in FIG. 7, the auger 63 equipped in the recovery portion 62 comprises a support shaft 65. One end portion of this support shaft 65 projects from the image unit S, and a gear 66 is fitted on this projecting portion. On the other hand, a support shaft 44 of the lower auger 42*b* of the developing device 4 integrally held by the identical image unit S also projects from the image unit S, and a gear 45 is fitted on this projecting portion. These gears 66 and 45 attached to the augers 63 and 42*b* mesh with each other.

The gear 45 of the lower auger 42*b* meshes with a gear (not shown) fitted on a support shaft of the magnet roller 41, and a gear (not shown) fitted on a support shaft of the upper auger 42.

The support shaft 44 of the lower auger 42*a* projects from the gear 45, and is fitted into a coupling 46. This coupling 46 is coupled to a driven gear 48 via a support shaft 47. Furthermore, this driven gear 48 meshes with a driving gear 50 fitted on the rotation shaft of a motor 49 as a driving source.

With this arrangement, the magnet roller 41 and the upper and lower augers 42*a* and 42*b* of the developing device 4 are rotated by the driving motor 49 as a driving source. Also, this driving motor 49 drives the auger 63 disposed in the recovery portion 62 integrated with the developing device 4.

According to the third embodiment, the image unit S which integrally holds the developing device 4 in a predetermined image forming unit, and the recovery portion 62 of the cleaning device 6 in an image forming unit which neighbors that image forming unit on its upstream side, is disposed. Hence, in this embodiment as well, the same effects as in the first and second embodiments can be obtained.

In this embodiment, since the blade 61 of the cleaning device 6 is aligned to the photosensitive drum 1 independently of the image unit S, the blade 61 can be solely aligned and set irrespective of the attached state of the image unit S.

Furthermore, according to this embodiment, the upper and lower augers 42*a* and 42*b* and magnet roller 41 of the developing device 4, and the auger 63 of the recovery portion 62, which are integrally held by the image unit S, are driven by the single driving motor 49. Therefore, in this embodiment, the number of components in the driving system such as a motor serving as a driving source and the like can be reduced, and the manufacturing cost of the apparatus can be reduced.

Figure 8:
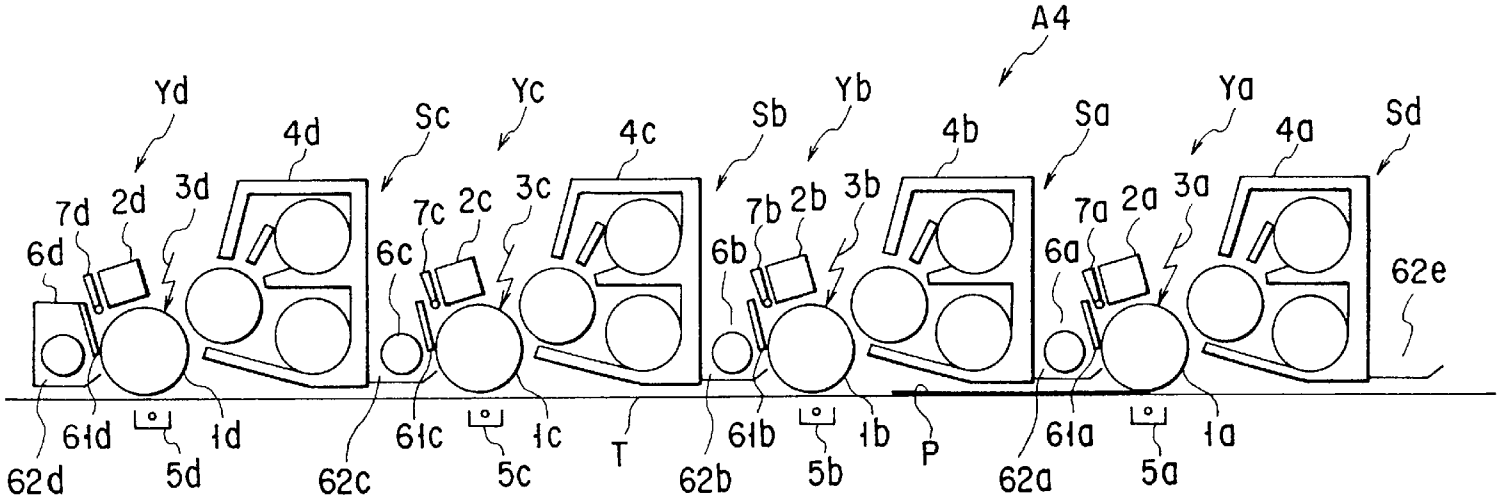
FIG. 8 is a schematic view showing the arrangement of an image forming module A4 according to the fourth embodiment of the present invention.

FIG. 8 schematically shows the arrangement of an image forming module A4 according to the fourth embodiment of the present invention.

The image forming module A4 comprises first to third image units Sa to Sc between neighboring photosensitive drums, as in the third embodiment described above. This image forming module further comprises a fourth image unit Sd on the upstream side of a first photosensitive drum 1*a*. Note that a cleaning device 6*d* for cleaning a fourth photosensitive drum 1*d* is solely mounted as in the third embodiment.

In the fourth image unit Sd, only a developing device 4*a* performs predetermined operation for the first photosensitive drum 1*a*, but a recovery portion 62*e* of a cleaning device integrally held by this image unit Sd does not perform any operation for the photosensitive drum 1*a*. Hence, the recovery portion 62*e* of the cleaning device equipped in the fourth image unit Sd is an extra one. For this reason, at least an auger 63 is removed from the fourth image unit Sd unlike in other image units Sa to Sc.

Therefore, according to the fourth embodiment, the same effects as in the aforementioned embodiments can be obtained. In addition, as compared to the third embodiment, as the first developing unit 4*a* need not be solely mounted, the number of types of members that construct the image forming module can be reduced, and labor required for managing such members can be lightened, thus greatly contributing to a great cost reduction.

Figure 9:
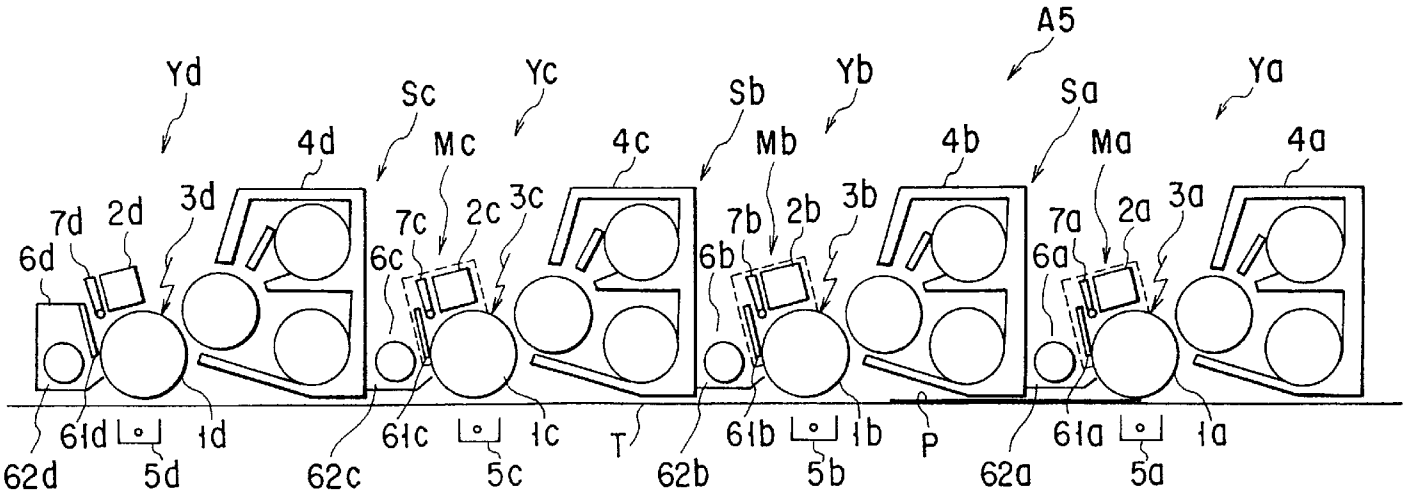
FIG. 9 is a schematic view showing the arrangement of an image forming module AS according to the fifth embodiment of the present invention.

FIG. 9 schematically shows the arrangement of an image forming module A5 according to the fifth embodiment of the present invention.

This image forming module A5 comprises first to third image units Sa to Sc between neighboring photosensitive drums, as in the third embodiment shown in FIG. 5. Each of the image units Sa to Sc of this embodiment integrally holds a developing device 4 in a predetermined image forming unit, and a recovery portion 62 of a cleaning device 6 in the upstream neighboring image forming unit.

Also, the image forming module A5 of this embodiment comprises first to third aligning units Ma to Mc facing first to third photosensitive drums 1*a* to 1*c*. These aligning units Ma to Mc rotatably support the opposing photosensitive drums 1*a* to 1*c*, and also hold charging devices 2*a* to 2*c*, charge removing devices 7*a* to 7*c*, and blades 61*a* to 61*c* of cleaning devices, which are aligned to the corresponding photosensitive drums 1*a* to 1*c*.

Note that a developing device 4*a* facing the first photosensitive drum 1*a*, and a cleaning device 6*d* facing a fourth photosensitive drum 1*d* are solely mounted as in the third embodiment.

More specifically, the drum surface of the first photosensitive drum 1*a* is charged by the charging device 2*a* in the first aligning unit Ma, and an electrostatic latent image on the drum surface is developed by the solely mounted developing device 4*a*. Residual toner on the drum surface of the first photosensitive drum 1*a* is scraped off by the blade 61*a* in the first aligning unit Ma, and is recovered by the recovery portion 62*a* of the first image unit Sa. Furthermore, residual charge on the drum surface of the first photosensitive drum 1*a* is removed by the charge removing device 7*a* in the first aligning unit Ma.

Similarly, the drum surface of the second photosensitive drum 1*b* is charged by the charging device 2*b* in the second aligning unit Mb, and an electrostatic latent image on the drum surface is developed by the developing device 4*b* in the first image unit Sa. Residual toner on the drum surface of the second photosensitive drum 1*b* is scraped off by the blade 61*b* in the second aligning unit Mb, and is recovered by the recovery portion 62*b* in the second image unit Sb. Furthermore, residual charge on the drum surface of the second photosensitive drum 1*b* is removed by the charge removing device 7*b* in the second aligning unit Mb.

Also, the drum surface of the third photosensitive drum 1*c* is charged by the charging device 2*c* in the third aligning unit Mc, and an electrostatic latent image on the drum surface is developed by the developing device 4*c* in the second image unit Sb. Residual toner on the drum surface of the third photosensitive drum 1*c* is scraped off by the blade 61*c* in the third aligning unit Mc, and is recovered by the recovery portion 62*c* in the third image unit Sc. Furthermore, residual charge on the drum surface of the third photosensitive drum 1*c* is removed by the charge removing device 7*c* in the third aligning unit Mc.

Furthermore, the drum surface of the fourth photosensitive drum 1*d* is charged by the solely mounted charging device 2*d*, and an electrostatic latent image on the drum surface is developed by the developing device 4*d* in the third image unit Sc. Residual toner on the drum surface of the fourth photosensitive drum 1*d* is scraped off by the blade 61*d* in the solely mounted fourth cleaning device 6*d*, and is recovered by the recovery portion 62*d*. Furthermore, residual charge on the drum surface of the fourth photosensitive drum 1*d* is removed by the solely mounted charge removing device 7*d*.

Figure 10:
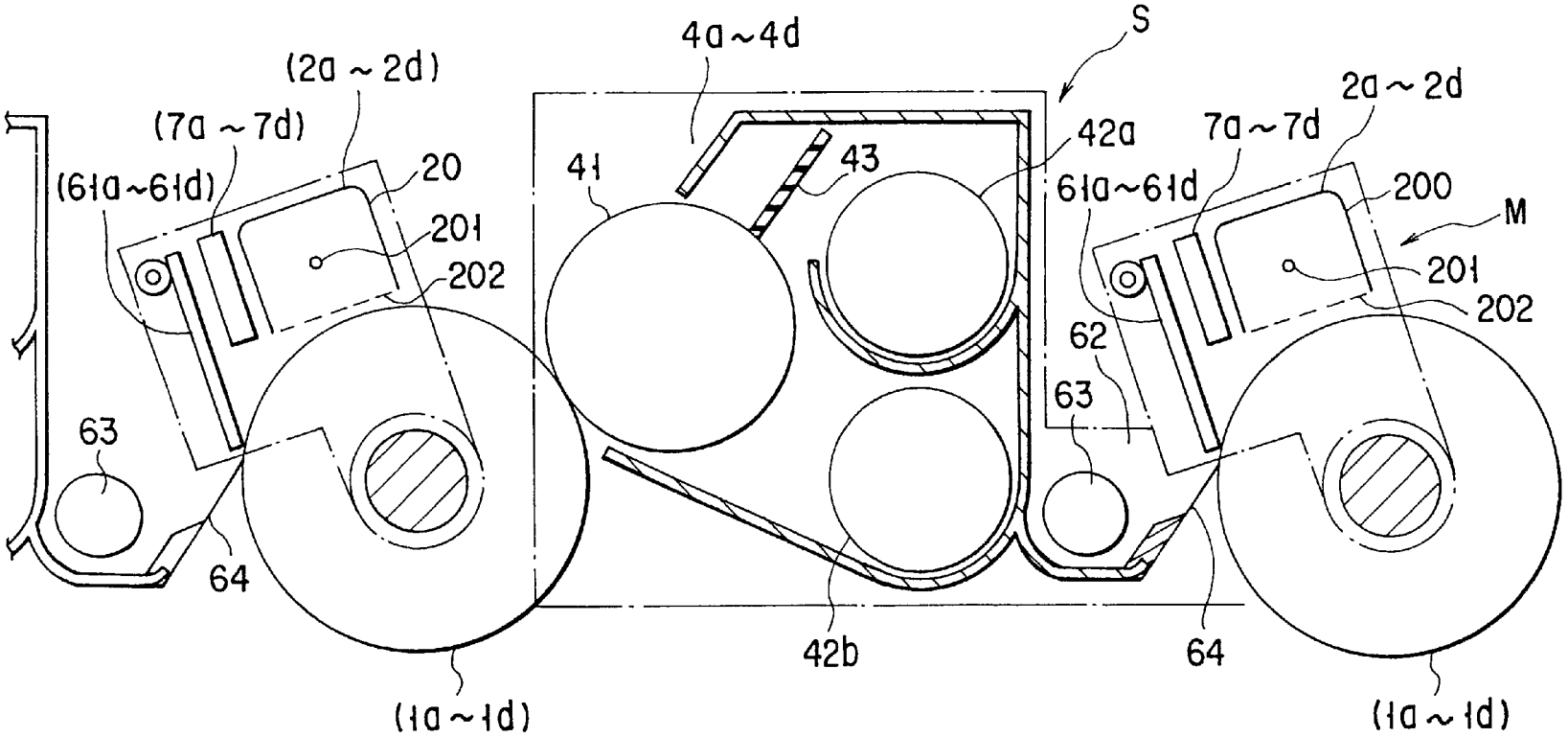
FIG. 10 is a schematic view showing an image unit and aligning unit attached to the image forming module shown in FIG. 9.

FIG. 10 shows the image unit S, aligning unit M, and their peripheral members built in the image forming module A5 shown in FIG. 9 in an enlarged scale. Note that the image unit S is detachably inserted into the space between the two photosensitive drums.

The developing device 4 integrally held by the image unit S has a magnet roller 41 for supplying toner onto the drum surface, a pair of vertically juxtaposed augers 42*a* and 42*b* for stirring and transferring toner stored in the developing device 4, and a blade 43 having a distal end which opposes the magnet roller 41 with a predetermined spacing.

Also, in the recovery portion 62 of the cleaning device 6 integrally held by the image unit S, an auger 63 for transferring the recovered toner in a predetermined direction is disposed. Furthermore, the recovery portion 62 has a recovering plate 64 for receiving toner scraped off by the blade 61 equipped in the upstream neighboring aligning unit M. The distal end of this recovering plate 64 projects to a position in the vicinity of the drum surface of the opposing photosensitive drum.

On the other hand, the aligning unit M rotatably and axially supports the photosensitive drum 1, and also supports the blade 61 of the cleaning device 6, charge removing device 7, and charging device 2, which are aligned to the drum surface of the photosensitive drum 1.

The charging device 2 supported by the aligning unit M has a casing 200 having an open surface opposing the photosensitive drum 1, a discharging wire 201 extending in the longitudinal direction (a direction perpendicular to the plane of the drawing of FIG. 10), and a grid 202 which covers the open surface of the casing 200.

The charging efficiency for the drum surface of the photosensitive drum 1 by the charging device 2 depends on the spacing between the grid 202 and drum surface. For this reason, when the charging device 2 is aligned to the drum surface, at least the grid 202 must be accurately aligned to the drum surface.

FIGS. 11 to 14 show the arrangements of the aligning unit M in detail.

Figure 11:
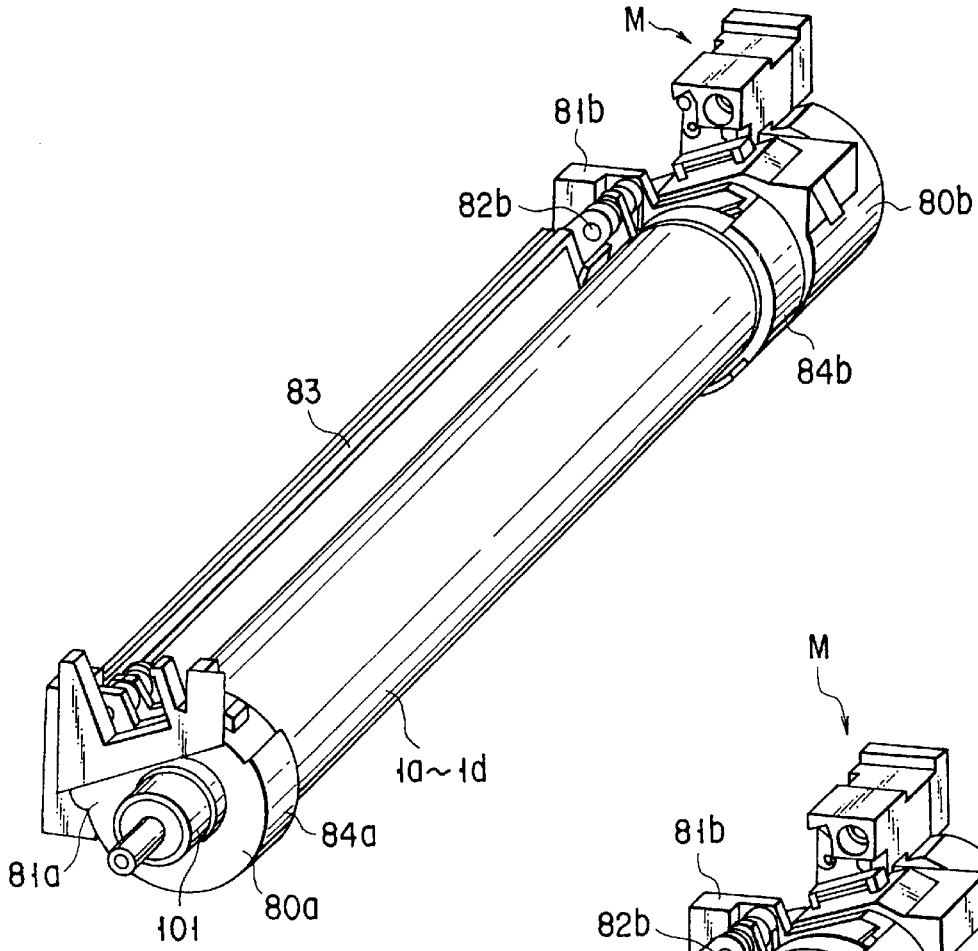
FIG. 11 is a perspective view for explaining the attached state of a photosensitive drum in the aligning unit shown in FIG. 10.

As shown in FIG. 11, the photosensitive drum 1 is supported by the aligning unit M. That is, a support shaft 101 projecting from the two end portions of the photosensitive drum 1 is axially supported by unit bearings 80*a* and 80*b* of the aligning unit M, so that the photosensitive drum 1 is supported by the aligning unit M.

Figure 12:
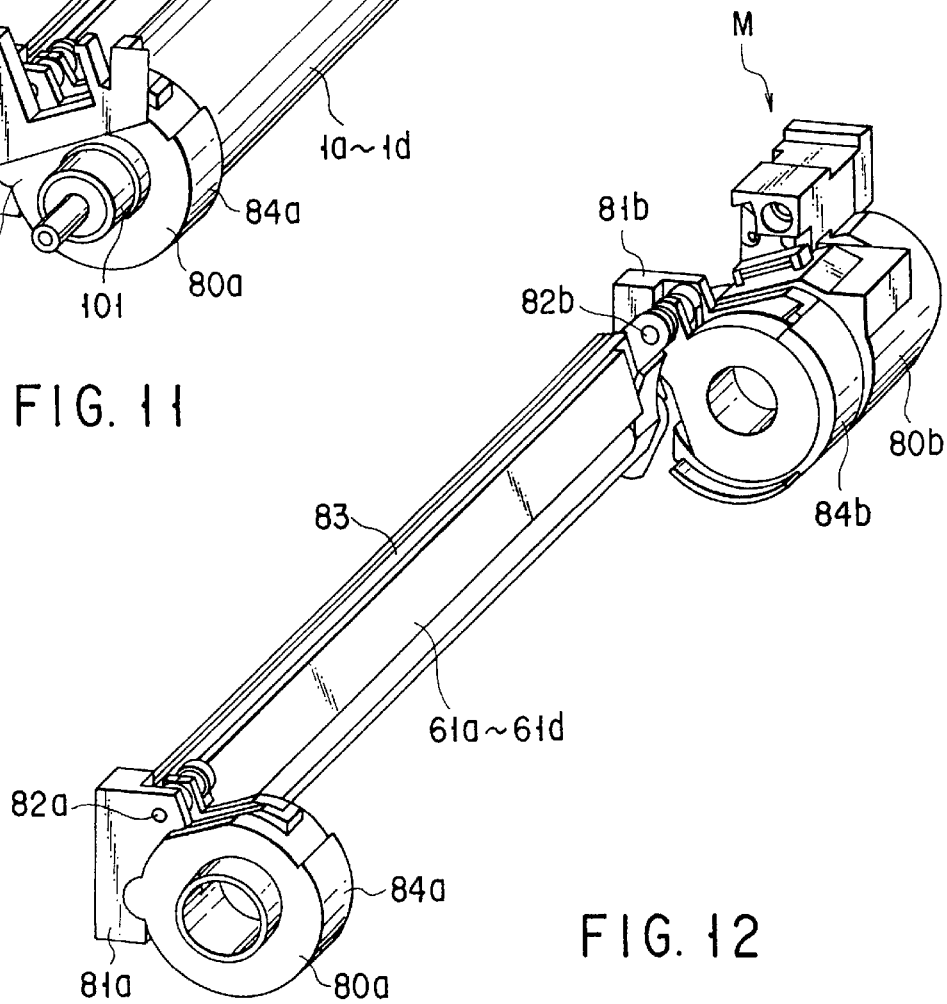
FIG. 12 is a perspective view showing the state wherein the photosensitive drum is removed from the aligning unit shown in FIG. 11.

FIG. 12 shows a state wherein the photosensitive drum 1 is detached from the unit bearings 80*a* and 80*b*. Flange portions 81*a* and 81*b* are respectively integrally formed on the unit bearings 80*a* and 80*b*. A blade support plate 83 is pivotally supported by these flange portions 81*a* and 81*b* via pins 82*a* and 82*b*. The blade 61 is attached to this blade support plate 83.

The leading edge of the blade 61 in its pivotal direction projects from the blade support plate 83 by a predetermined length, and this leading edge portion of the blade 61 is elastically pressed against the photosensitive drum 1. Hence, by adjusting the projecting amount of the leading edge portion of the blade 61 from the blade support plate 83, the leading edge of the blade 61 can be aligned to the photosensitive drum 1.

Note that the blade 61 is pivotally and axially supported by the flange portions 81*a* and 81*b* via the pins 82*a* and 82*b*, and is biased toward the drum surface by a spring (not shown). With this structure, the blade 61 is pressed against the photosensitive drum 1 at a predetermined pressure, and can scrape off residual toner on the drum surface.

Figure 13:
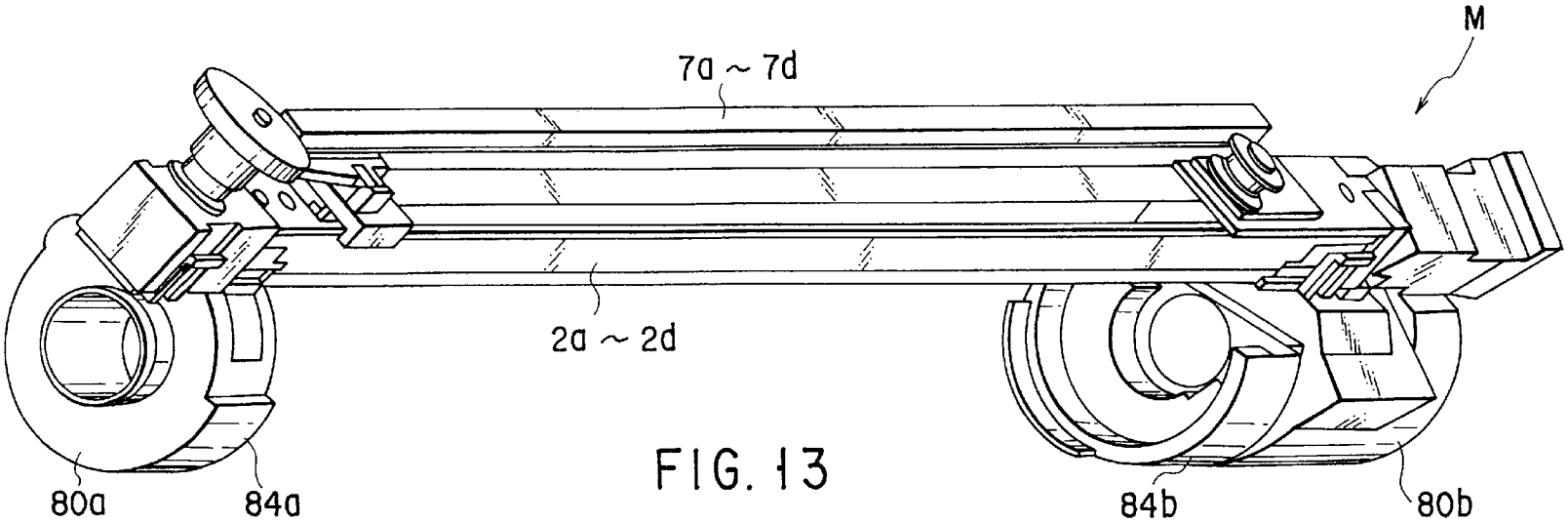
FIG. 13 is a perspective view for explaining the attached state of a charging device and charge removing device in the aligning unit shown in FIG. 10.
Figure 14:
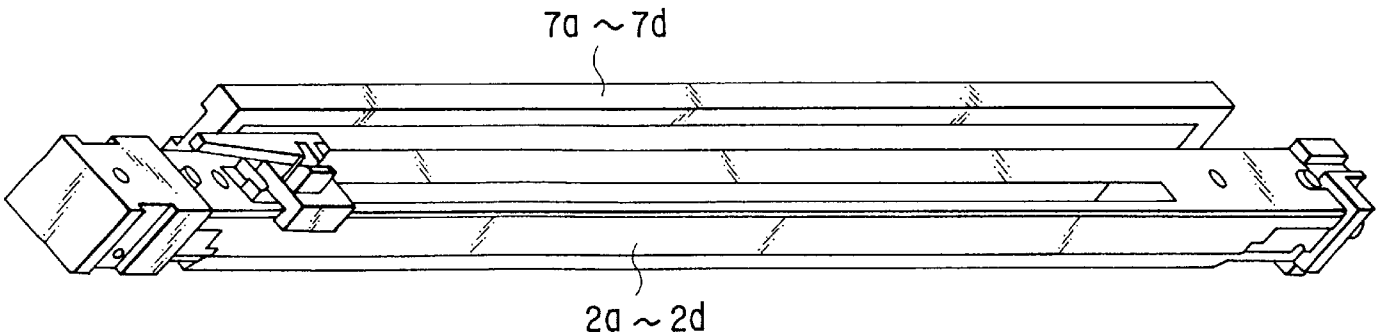
FIG. 14 is a perspective view showing the charging device and charge removing device to be attached to the aligning unit shown in FIG. 13.

As shown in FIG. 13, the charging device 2 and charge removing device 7 are attached between the unit bearings 80*a* and 80*b* of the aligning unit M. FIG. 14 shows the charging device 2 and charge removing device 7 detached from the unit bearings 80*a* and 80*b* of the aligning unit M.

More specifically, the support shaft 101 of the photosensitive drum 1 is supported by the aligning unit M that holds the charging device 2 and charge removing device 7. More specifically, the photosensitive drum 1, charging device 2, and charge removing device 7 are attached to a single unit M, and the spacing between the photosensitive drum 1, and the charging device 2 and charge removing device 7 is automatically set, thus aligning the charging device 2 and charge removing device 7 to the photosensitive drum 1.

Also, the unit bearings 80*a* and 80*b* of the aligning unit M respectively have projecting portions 84*a* and 84*b* for aligning the neighboring developing device to the photosensitive drum 1. These projecting portions 84*a* and 84*b* contact the two side edge portions of the magnet roller 41 of the developing device 4. Hence, the aligning unit M comprises a means for aligning the developing device 4 to the photosensitive drum 1.

To restate, according to this embodiment, the image unit S and aligning unit M for supporting the photosensitive drum 1 is equipped between neighboring photosensitive drums 1. The aligning unit M aligns the blade 61 of the cleaning device 6, charge removing device 7, charging device 2, and developing device 4 to the photosensitive drum 1 with high accuracy.

For this reason, in the image forming module A5 of this embodiment, most of constituent devices can be integrally held by the image unit S and aligning unit M as units, and operations pertaining to the manufacture, management, and attachment of the constituent devices can be facilitated very much. In this embodiment as well, the size of the image forming module in its longitudinal direction can be reduced and, hence, the total length of the copying machine can be shortened as in the above embodiments.

Figure 15:
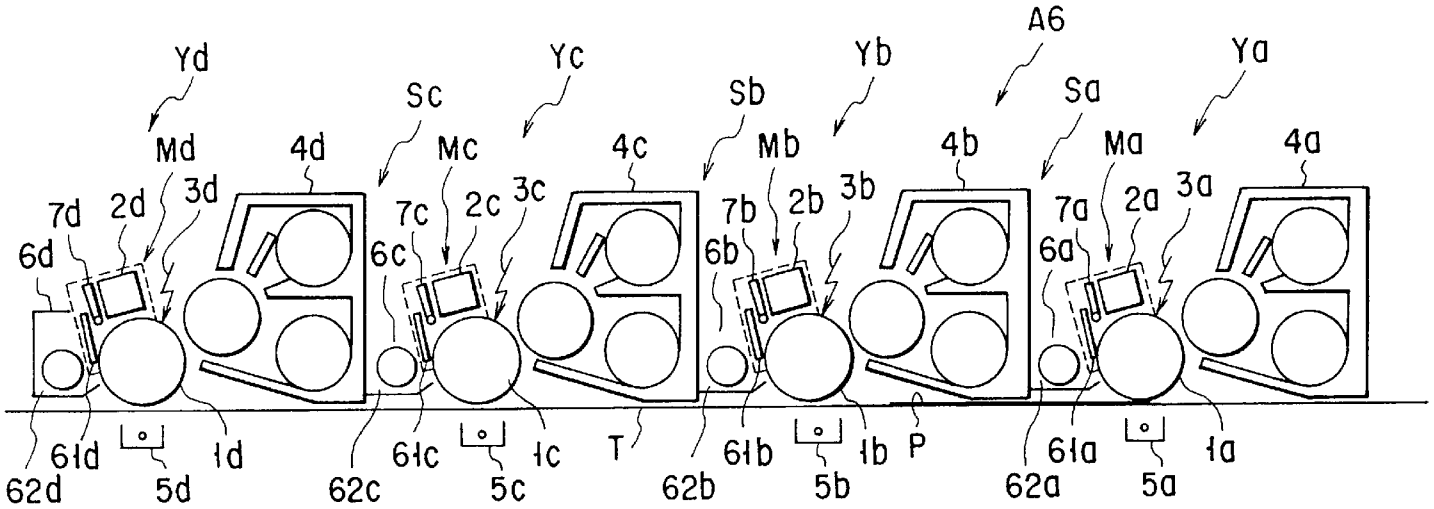
FIG. 15 is a schematic view showing the arrangement of an image forming module A6 according to the sixth embodiment of the present invention.

FIG. 15 schematically shows the arrangement of an image forming module A6 according to the sixth embodiment of the present invention.

This image forming module A6 further comprises a fourth aligning unit Md for aligning a blade 61*d* of a cleaning device 6*d*, which opposes a fourth photosensitive drum 1*d*, charge removing device 7*d*, and charging device 2*d* with respect to the drum surface, and other arrangements are the same as those in the image forming module A5 of the fifth embodiment shown in FIG. 9.

In this image forming module A6 as well, most of constituent devices except for a first developing device 4*a* and a recovery portion 62*d* of the fourth cleaning device 6*d* can be integrated by an image unit S and aligning unit M, and operations pertaining to the manufacture, management, and attachment of the constituent devices can be facilitated very much. Hence, the need for alignment and adjustment of the individual constituent devices with respect to the photosensitive drums 1 can be obviated, thus greatly reducing the number of processes.

Figure 16:
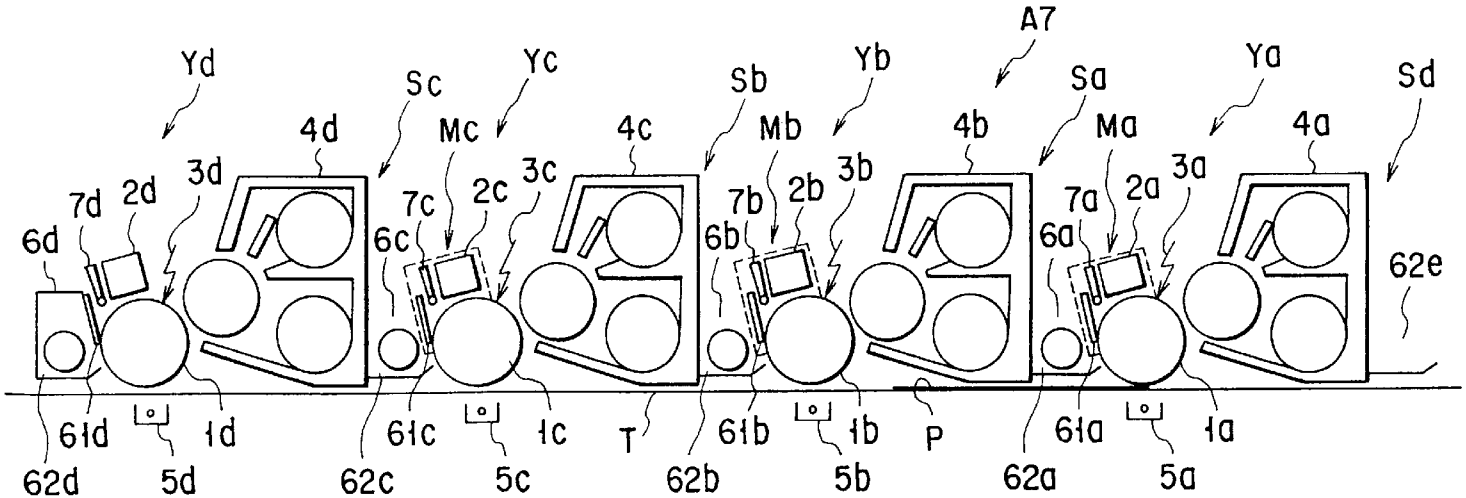
FIG. 16 is a schematic view showing the arrangement of an image forming module A7 according to the seventh embodiment of the present invention.

FIG. 16 schematically shows the arrangement of an image forming module A7 according to the seventh embodiment of the present invention.

In this image forming module A7, a fourth image unit Sd excluding an auger 63*e* is set in place of a sole developing device 4*a* opposing a first photosensitive drum 1*a*, and other arrangements are the same as those in the image forming module A5 of the fifth embodiment shown in FIG. 9.

According to this image forming module A7, the image developing device 4*a* need not be mounted solely, and can be replaced by the image unit Sd. As a consequence, the number of types of members that construct the image forming module can be reduced, and labor required for manufacturing and managing such members can be eliminated, thus reducing the manufacturing cost. In this image forming module A7, most of constituent devices can be held as units, and operations pertaining to the manufacture, management, and attachment of the constituent devices can be facilitated very much. Hence, the need for alignment and adjustment of the individual constituent devices with respect to the photosensitive drums 1 can be obviated, and the number of processes can be greatly reduced.

Figure 17:
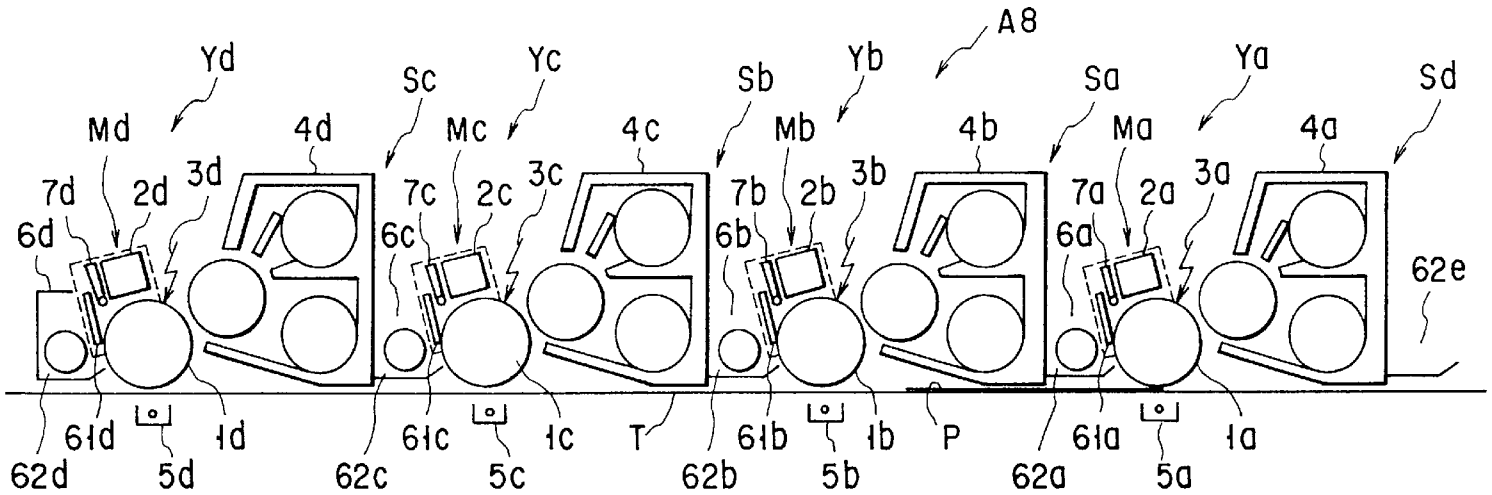
FIG. 17 is a schematic view showing the arrangement of an image forming module A8 according to the eighth embodiment of the present invention.

FIG. 17 schematically shows the arrangement of an image forming module A8 according to the eighth embodiment of the present invention.

This image forming module A8 further comprises a fourth aligning unit Md for aligning a blade 61*d* of a cleaning device 6*d* opposing a fourth photosensitive drum 1*d*, charge removing device 7*d*, and charging device 2*d* with respect to the drum surface, and other arrangements are the same as those in the image forming module A7 of the seventh embodiment shown in FIG. 16.

According to this image forming module A8, the image developing device 4*a* need not be mounted solely, and can be replaced by the image unit Sd. As a consequence, the number of types of members that construct the image forming module can be reduced, and labor required for manufacturing and managing such members can be eliminated, thus reducing the manufacturing cost. In this image forming module A8, most of constituent devices except for a recovery portion 62*d* of the fourth cleaning device 6*d* can be integrated by image units S and aligning units M, and operations pertaining to the manufacture, management, and attachment of the constituent devices can be facilitated very much. Hence, the need for alignment and adjustment of the individual constituent devices with respect to the photosensitive drums 1 can be obviated, and the number of processes can be greatly reduced.

Figure 18:
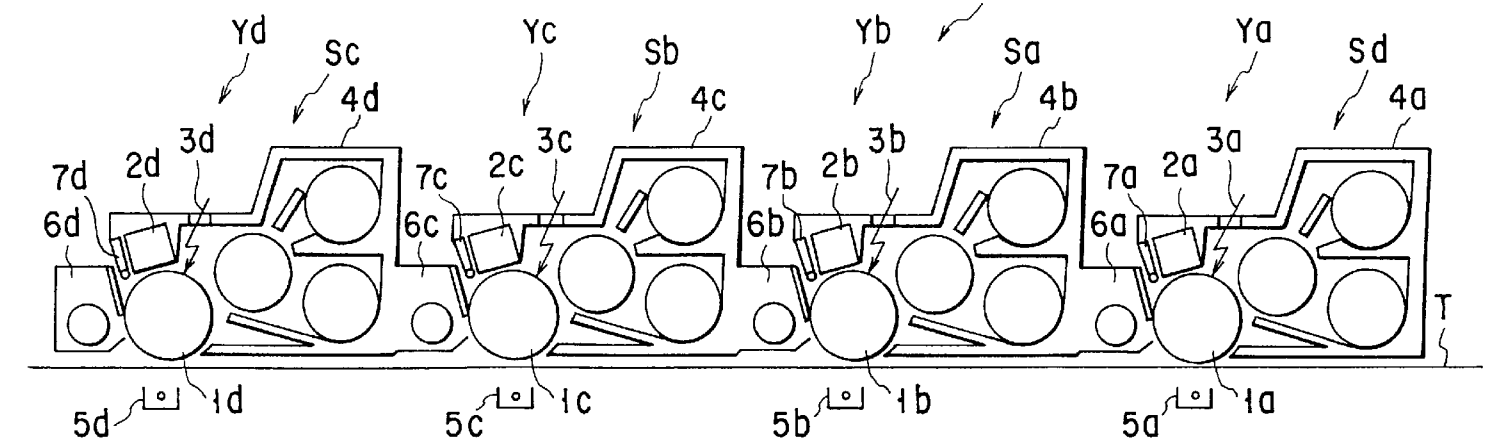
FIG. 18 is a schematic view showing the arrangement of an image forming module A9 according to the ninth embodiment of the present invention.

FIG. 18 schematically shows the arrangement of an image forming module A9 according to the ninth embodiment of the present invention.

This image forming module A9 has four image units Sa to Sd which integrate combinations of constituent devices 1 to 7 of four image forming units Ya to Yd. The most upstream, fourth image unit Sd integrally holds a first photosensitive drum 1*a*, charging device 2*a*, developing device 4*a*, and charge removing device 7*a*. Also, the first to third image units Sa to Sc at the second to fourth upstream positions respectively integrally hold the second to fourth photosensitive drums 1*b* to 1*d*, charging devices 2*b* to 2*d*, developing devices 4*b* to 4*d*, and charge removing devices 7*b* to 7*d*, which oppose these photosensitive drums 1*b* to id, and upstream neighboring cleaning devices 6*a* to 6*c*. More specifically, the most upstream, fourth image unit S has no unnecessary cleaning device unlike in other image units Sa to Sc. Note that a fourth cleaning device 6*d* is solely mounted.

Figure 19:
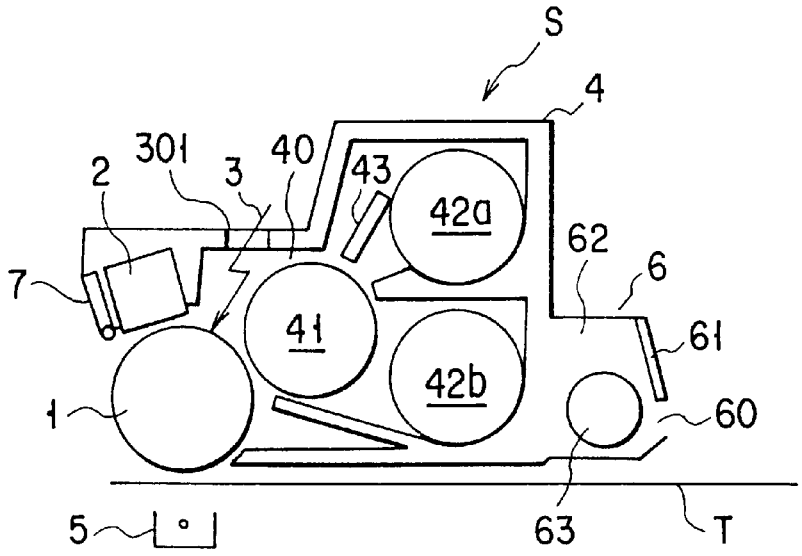
FIG. 19 is a schematic view showing an image unit attached to the image forming module shown in FIG. 18.

FIG. 19 shows one of the first to third image units Sa to Sc built in the image forming module A9 shown in FIG. 18. Note that the fourth image unit Sd has substantially the same arrangement as those of the first to third image units Sa to Sc, except that it does not comprise any cleaning device 6, and a detailed description thereof will be omitted.

The image units Sa to Sc respectively integrally hold the predetermined photosensitive drums 1*b* to 1*d*, charge removing devices 7*b* to 7*d*, charging devices 2*b* to 2*d*, and developing devices 4*b* to 4*d*, which oppose these photosensitive drums 1*b* to id, and cleaning devices 6*a* to 6*c* for cleaning the drum surfaces of the photosensitive drums 1*a* to 1*d* which respectively neighbor the drums 1*b* to 1*d* held in the corresponding units on their upstream sides.

The developing device 4 integrally held by the image unit S (Sa to Sc) has an opening 40 on a portion opposing a predetermined photosensitive drum 1. In this opening 40, a magnet roller 41 for supplying toner onto the drum surface is rotatably arranged to oppose the drum surface with a given spacing. The developing device 4 also has a pair of vertically juxtaposed augers 42*a* and 42*b* for stirring and transferring toner stored in the device. Furthermore, the developing device 4 has a blade 43 which has a distal end that opposes the magnet roller 41 with a given spacing, and this blade 43 controls the thickness of the toner layer that becomes attached to the circumferential surface of the magnet roller 41.

On the other hand, the cleaning device 6 integrally held by this image unit S has an opening 60 on a portion facing the upstream photosensitive drum 1. In this opening 60, a blade 61 as a scraping means for scraping off residual toner on the drum surface is disposed. The distal end of this blade 61 is elastically pressed against the drum surface at a given pressure. The cleaning device 6 comprises a recovery portion 62 for recovering toner scraped off by the blade 61, and an auger 63 for transferring the toner recovered in the recovery portion 62 in a predetermined direction.

The charge removing device 7 and charging device 2 integrally held by the image unit S are aligned to the drum surface of the photosensitive drum 1 with a predetermined spacing. Furthermore, a slit-like window 301 for passing a laser beam 3 irradiated onto the drum surface via a laser unit 19 is formed on a given portion of the image unit S.

Hence, the potential on the drum surface of the first photosensitive drum 1*a* is removed by the charge removing device 7*a* integrally held by the most upstream fourth image unit Sd, the drum surface is charged to a predetermined potential by the charging device 2*a*, and an electrostatic latent image on the drum surface is developed by the developing device 4*a*.

Also, residual charge on the drum surface of the second photosensitive drum 1*b* is removed by the charge removing device 7*b* integrally held by the first image unit Sa, and this drum surface is charged by the charging device 2*b*. An electrostatic latent image on the second photosensitive drum 1*b* is developed by the developing device 4*b* integrally held by this unit Sa, and the surface of the first photosensitive drum 1*a* is cleaned by the cleaning device 6*a*.

Similarly, residual charge on the drum surface of the third photosensitive drum 1*c* is removed by the charge removing device 7*c* integrally held by the second image unit Sb, and this drum surface is charged by the charging device 2*c*. An electrostatic latent image on the third photosensitive drum 1*c* is developed by the developing device 4*c* integrally held by this unit Sb, and the surface of the second photosensitive drum 1*b* is cleaned by the cleaning device 6*b*.

Furthermore, residual charge on the drum surface of the fourth photosensitive drum 1*d* is removed by the charge removing device 7*d* integrally held by the third image unit Sc, and this drum surface is charged by the charging device 2*d*. An electrostatic latent image on the fourth photosensitive drum 1*d* is developed by the developing device 4*d* integrally held by this unit Sc, and the surface of the third photosensitive drum 1*c* is cleaned by the cleaning device 6*c*. Moreover, the drum surface of the fourth photosensitive drum 1*d* is cleaned by the standalone cleaning device 6*d*.

To recapitulate, according to the image forming module A9 of this embodiment, since the first to third image units Sa to Sc integrally hold the downstream developing devices 4 and upstream cleaning devices 6, which neighbor each other, no extra frames between these developing devices 4 and cleaning devices 6 are required. In this embodiment, since nearly all constituent devices 1 to 7 except for the fourth cleaning device 6*d* are integrally held as units, no work spaces required for individually attaching the constituent devices 1 to 7 are required, and the attachment spacings of the individual constituent devices can be reduced. With this arrangement, the size of the image forming module A9 in its longitudinal direction can be shortened, and the entire color copying machine can be made compact. More specifically, as compared to the conventional image forming module (FIG. 27) in which four monochrome image forming units are juxtaposed, the unit for each color can be shortened by around 6 mm, and the module for a total of four colors can be shortened by about 20 mm.

In this embodiment, since most of constituent devices that construct the image forming module A9 can be integrated, the number of processes required for assembling upon attaching the individual constituent devices to the image forming module of the copying machine can be reduced, and adjustment of the attachment positions of the respective constituent devices can be facilitated very much. Furthermore, since the image units Sa to Sd are used, labor required for managing the constituent devices 1 to 7 that build the image forming module A9 can be eliminated, and consequently, the manufacturing cost of the copying machine can be reduced.

Figure 20:
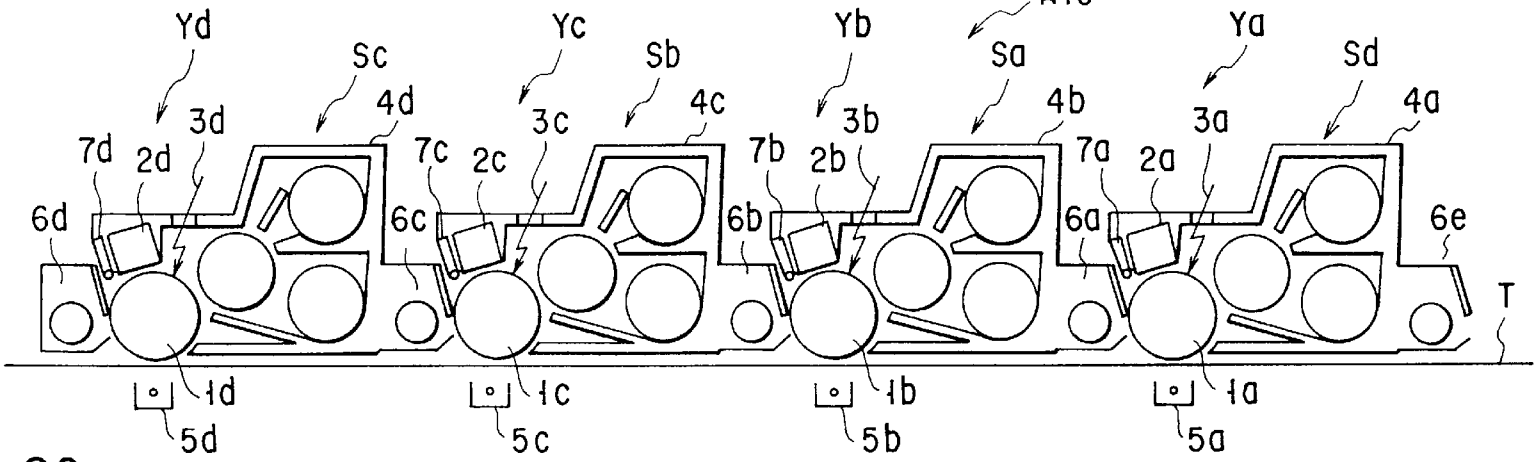
FIG. 20 is a schematic view showing the arrangement of an image forming module A10 according to the 10th embodiment of the present invention.

FIG. 20 schematically shows the arrangement of an image forming module A10 according to the 10th embodiment of the present invention.

This image forming module A10 comprises a fourth image unit Sd which is the same as the first to third image units Sa to Sc, in place of the above-mentioned fourth image unit Sd having no cleaning device, and other arrangements are the same as those of the image forming module A9 shown in FIG. 18.

More specifically, in the fourth image unit Sd, a charge removing device 7*a*, charging device 2*a*, and developing device 4*a* perform predetermined operations with respect to a first photosensitive drum 1*a*, and a cleaning device 6*e* integrally held by this image unit Sd does not perform any operation for the photosensitive drum 1*a*. Hence, the cleaning device 6*e* equipped in the fourth image unit Sd is an extra one. However, the fourth image unit Sd with a structure different from those of other image units Sa to Sc need not be prepared unlike in the ninth embodiment shown in FIG. 18, and identical image units can be used.

For this reason, according to this embodiment, the same effect as in the ninth embodiment described above can be obtained. In addition, as compared to the ninth embodiment, the number of types of members that construct the image forming module can be reduced, and labor required for managing such members can be eliminated, thus contributing to a great cost reduction.

Figure 21:
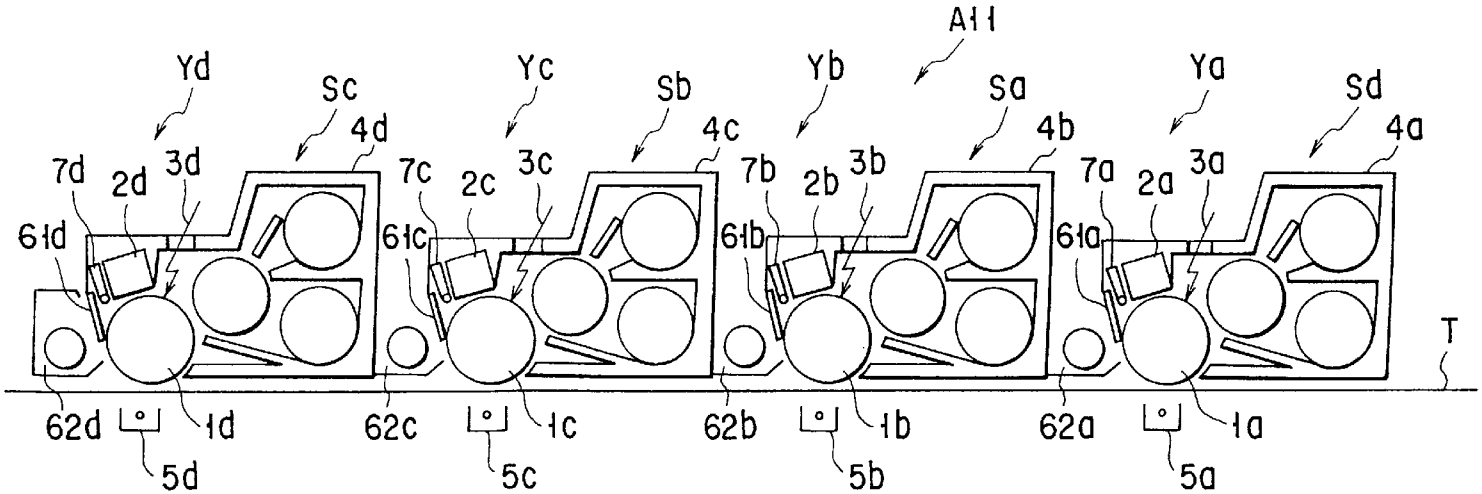
FIG. 21 is a schematic view showing the arrangement of an image forming module A11 according to the 11th embodiment of the present invention.

FIG. 21 schematically shows the arrangement of an image forming module A11 according to the 11th embodiment of the present invention.

This image forming module A11 has four image units Sa to Sd which integrate combinations of constituent devices 1 to 7 of four image forming units Ya to Yd. The most upstream, fourth image unit Sd integrally holds a first photosensitive drum 1*a*, charging device 2*a*, developing device 4*a*, a blade 61*a* of a cleaning device, and charge removing device 7*a*, which oppose the photosensitive drum 1*a*. Also, the first to third image units Sa to Sc at the second to fourth upstream positions respectively integrally hold the second to fourth photosensitive drums 1*b* to 1*d*, charging devices 2*b* to 2*d*, developing devices 4*b* to 4*d*, blades 61*b* to 61*d* of cleaning devices, charge removing devices 7*b* to 7*d*, which oppose these photosensitive drums 1*b* to 1*d*, and recovery portions 62*a* to 62*c* of upstream neighboring cleaning devices. That is, the most upstream fourth image unit Sd comprises neither a recovery portion nor auger in a cleaning device unlike in other image units Sa to Sc. Note that a cleaning device 62*d* of the fourth cleaning device is solely mounted.

Figure 22:
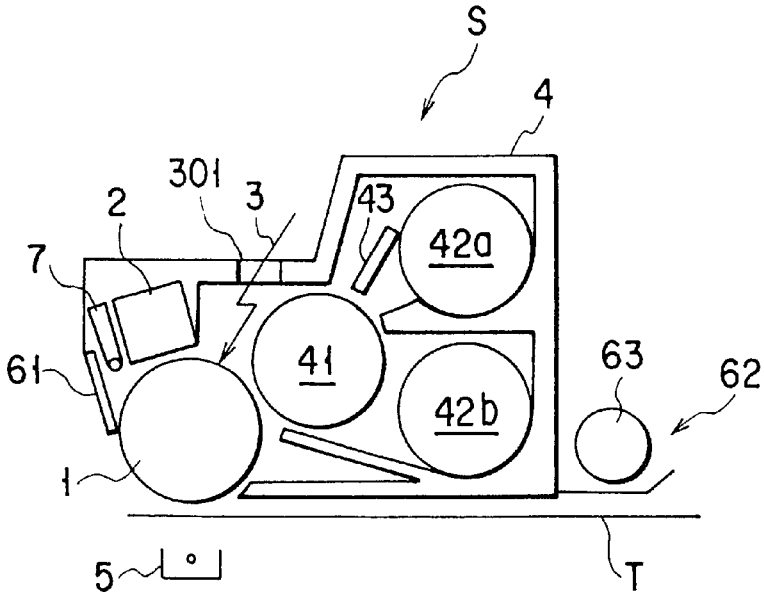
FIG. 22 is a schematic view showing an image unit attached to the image forming module shown in FIG. 21.

FIG. 22 shows one of the first to third image units Sa to Sc built in the image forming module A9 shown in FIG. 21. Note that the fourth image unit Sd has substantially the same arrangement as those of the first to third image units Sa to Sc, except that it does not comprise any recovery portion 62 of the cleaning device, and a detailed description thereof will be omitted.

The image units Sa to Sc respectively integrally hold the predetermined photosensitive drums 1*b* to 1*d*, charging devices 2*b* to 2*d*, developing devices 4*b* to 4*d*, blades 61*b* to 61*d* of the cleaning devices, and charge removing devices 7*b* to 7*d*, which oppose these photosensitive drums 1*b* to 1*d*, and the recovery portions 62*a* to 62*c* for recovering toner scraped off from the drum surfaces of the photosensitive drums 1*a* to 1*c* which neighbor the photosensitive drums 1*b* to 1*d* in their own units on their upstream sides.

The developing device 4 integrally held by the image unit S (Sa to Sc) has an opening 40 on a portion opposing the corresponding photosensitive drum 1. In this opening 40, a magnet roller 41 for supplying toner onto the drum surface is rotatably arranged to oppose the drum surface with a given spacing. The developing device 4 also has a pair of vertically juxtaposed augers 42*a* and 42*b* for stirring and transferring toner stored in the device. Furthermore, the developing device 4 has a blade 43 which has a distal end that opposes the magnet roller 41 with a given spacing, and this blade 43 controls the thickness of the toner layer that becomes attached to the circumferential surface of the magnet roller 41.

On the other hand, in the recovery portion 62 of the cleaning device integrally held by this image unit S, an auger 63 for transferring recovered toner in a predetermined direction is disposed. This auger 63 transfers toner which has been scraped off by the blade 61 integrally held by the upstream neighboring image unit from the drum surface of the upstream neighboring photosensitive drum, and recovered by the recovery portion 62.

The blade 61, charge removing device 7., and charging device 2 integrally held by the image unit S are aligned with respect to the drum surface of the photosensitive drum 1 via a predetermined spacing. Especially, the blade 61 is aligned and set, so that its leading edge is pressed against the drum surface at a predetermined pressure. Furthermore, a slit-like window 301 for passing a laser beam 3 irradiated onto the drum surface via a laser unit 19 is formed on a given portion of the image unit S.

Hence, residual toner on the drum surface of the first photosensitive drum 1*a* is scraped off by the blade 61 integrally held by the most upstream, fourth image unit Sd, and residual charge on that drum surface is removed by the charge removing device 7*a*. Then, this drum surface is charged to a predetermined potential by the charging device 2*a*, and an electrostatic latent image on the drum surface is developed by the developing device 4*a*.

Also, residual toner on the drum surface of the second photosensitive drum 1*b* is scraped off by the blade 61*b* integrally held by the first image unit Sa, and residual charge on this drum surface is removed by the charge removing device 7*b*. Then, this drum surface is charged by the charging device 2*b*, and an electrostatic latent image on the drum surface is developed by the developing device 4*b*. The recovery portion 62*a* of the cleaning device integrally held by this image unit Sa recovers toner scraped off by the blade 61*a* integrally held by the fourth image unit Sd.

Similarly, residual toner on the drum surface of the third photosensitive drum 1*c* is scraped off by the blade 61*c* integrally held by the second image unit Sb, and residual charge on this drum surface is removed by the charge removing device 7*c*. Then, this drum surface is charged by the charging device 2*c*, and an electrostatic latent image on the drum surface is developed by the developing device 4*c*. The recovery portion 62*b* of the cleaning device integrally held by this image unit Sb recovers toner scraped off by the blade 61*b* integrally held by the first image unit Sa.

Furthermore, residual toner on the drum surface of the fourth photosensitive drum 1*d* is scraped off by the blade 61*d* integrally held by the third image unit Sc, and residual charge on this drum surface is removed by the charge removing device 7*d*. Then, this drum surface is charged by the charging device 2*d*, and an electrostatic latent image on the drum surface is developed by the developing device 4*d*. The recovery portion 62*c* of the cleaning device integrally held by this image unit Sc recovers toner scraped off by the blade 61*c* integrally held by the second image unit Sb. Moreover, the recovery portion 62*d* which is solely mounted to face the fourth photosensitive drum 1*d* recovers toner scraped off by the blade 61*d* integrally held by the third image unit Sc.

As described above, according to the image forming module A11 of this embodiment, since the first to third image units Sa to Sc integrally hold the downstream developing devices 4 and upstream cleaning devices 6, which neighbor each other, no extra frames between these developing devices 4 and cleaning devices 6 are required. In this embodiment, since nearly all constituent devices 1 to 7 except for the recovery portion 62*d* of the fourth cleaning device are integrally held as units, no work spaces required for individually attaching the constituent devices 1 to 7 are required, and the attachment spacings of the individual constituent devices can be reduced. With this arrangement, the size of the image forming module A11 in its longitudinal direction can be shortened greatly, and the entire color copying machine can be rendered compact.

In this embodiment, since most of constituent devices that construct the image forming module A11 can be integrated, the number of processes required for assembling upon attaching the individual constituent devices to the image forming module of the copying machine can be reduced, and adjustment of the attachment positions of the respective constituent devices can be facilitated very much. Furthermore, since the image units Sa to Sd are used, labor required for managing the constituent devices 1 to 7 that build the image forming module A11 can be eliminated, and consequently, the manufacturing cost of the copying machine can be reduced.

Figure 23:
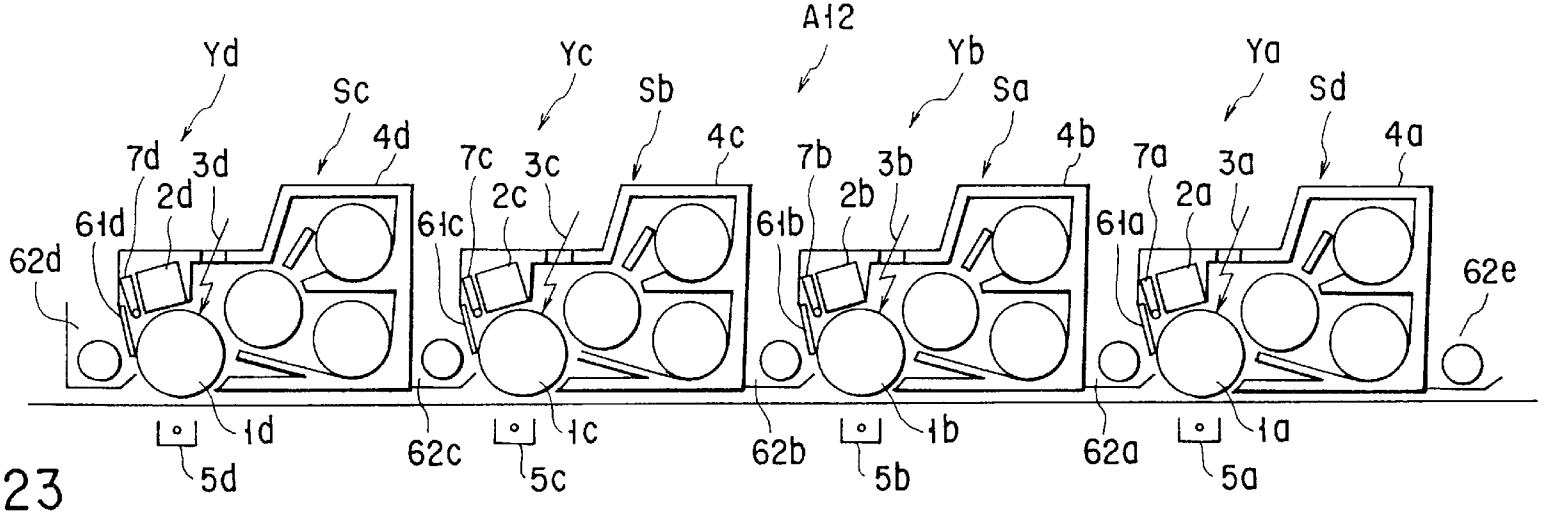
FIG. 23 is a schematic view showing the arrangement of an image forming module A12 according to the 12th embodiment of the present invention.

FIG. 23 schematically shows the arrangement of an image forming module A12 according to the 12th embodiment of the present invention.

This image forming unit A12 comprises a fourth image unit Sd having the same arrangement as those of the first to third image units Sa to Sc, and other arrangements are the same as those in the image forming module A11 shown in FIG. 21.

That is, in the fourth image unit Sd, a blade 61*a*, charge removing device 7*a*, charging device 2*a*, and developing device 4*a* perform predetermined operations for a first photosensitive drum 1*a*, and a recovery portion 62*e* of a cleaning device integrally held by this image unit Sd does not perform any operations for the photosensitive drum 1*a*. Hence, the recovery portion 62*e* equipped in the fourth image unit Sd is an extra one. However, the fourth image unit Sd with a structure different from those of other image units Sa to Sc need not be prepared unlike in the 11th embodiment shown in FIG. 21, and identical image units can be used.

For this reason, according to this embodiment, the same effect as in the 11th embodiment described above can be obtained. In addition, as compared to the 11th embodiment, the number of types of members that construct the image forming module can be reduced, and labor required for managing such members can be eliminated, thus contributing to a great cost reduction.

Figure 24:
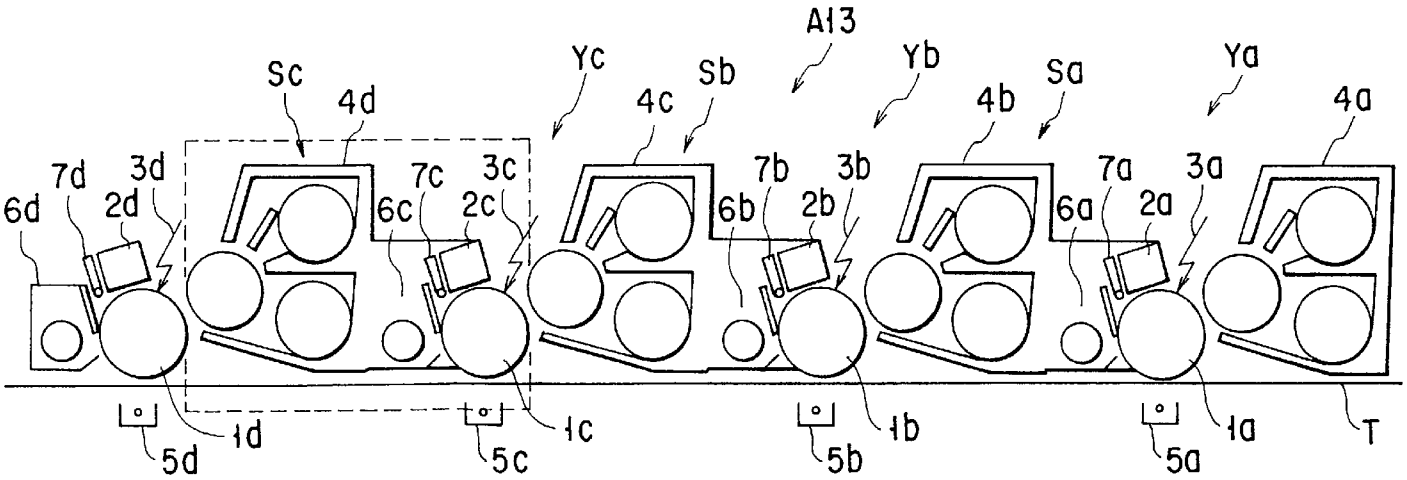
FIG. 24 is a schematic view showing the arrangement of an image forming module A13 according to the 13th embodiment of the present invention.

FIG. 24 schematically shows the arrangement of an image forming module A13 according to the 13th embodiment of the present invention.

The image forming module A13 has first to third image units Sa to Sc respectively including first to third photosensitive drums 1*a* to 1*c*. The first to third image units Sa to Sc respectively integrally hold the first to third photosensitive drums 1*a* to 1*c*, charging devices 2*a* to 2*c*, cleaning devices 6*a* to 6*c*, and charge removing devices 7*a* to 7*c*, which oppose these photosensitive drums 1*a* to 1*c*, and downstream neighboring developing devices 4*b* to 4*d*. Note that a first developing device 4*a*, fourth cleaning device 6*d*, fourth charge removing device 7*d*, and fourth charging device 4*d* are solely mounted.

Figure 25:
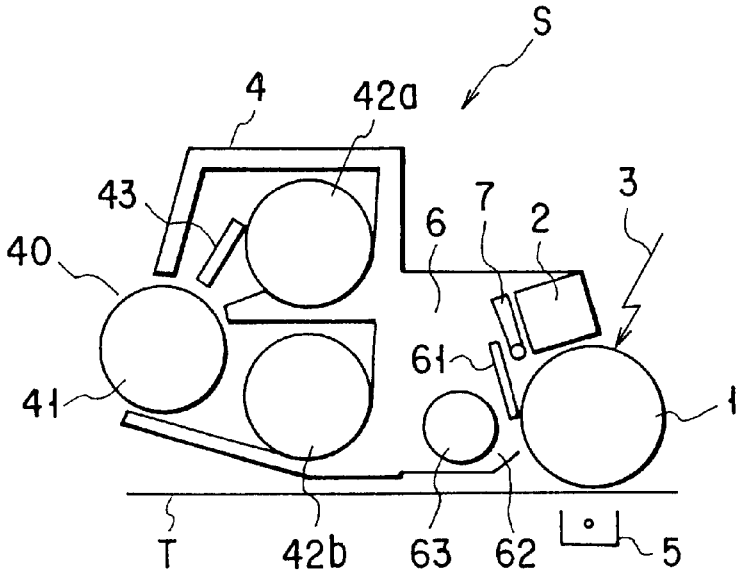
FIG. 25 is a schematic view showing an image unit attached to the image forming module shown in FIG. 24.

FIG. 25 shows one of the first to third image units Sa to Sc built in the image forming module A13 shown in FIG. 24.

The image units Sa to Sc respectively integrally hold the predetermined photosensitive drums 1*a* to 1*c*, cleaning devices 6*a* to 2*c*, charge removing devices 7*a* to 7*c*, and charging devices 2*a* to 2*c*, which oppose these photosensitive drums 1*a* to 1*c*, and developing device 4*b* to 4*d* for developing electrostatic latent images formed on the drum surfaces of the downstream neighboring photosensitive drums 1*b* to 1*d*, which respectively neighbor these photosensitive drums 1*a* to 1*c* in their own units on their downstream sides.

The developing device 4 integrally held by the image unit S (Sa to Sc) has an opening 40 on a portion facing the photosensitive drum which is integrally held by the image unit which neighbors the image unit S of interest on its downstream side. In this opening 40, a magnet roller 41 for supplying toner onto that drum surface of the downstream neighboring photosensitive drum is rotatably arranged. The developing device 4 also has a pair of vertically juxtaposed augers 42*a* and 42*b* for stirring and transferring toner stored in the device. Furthermore, the developing device 4 has a blade 43 which has a distal end that opposes the magnet roller 41 with a given spacing, and this blade 43 controls the thickness of the toner layer that becomes attached to the circumferential surface of the magnet roller 41.

On the other hand, the cleaning device 6 integrally held by this image unit S has a blade 61 which contacts the drum surface of the photosensitive drum 1 integrally held by the own unit at a predetermined pressure. The cleaning device 6 also has a recovery portion 62 for recovering toner scraped off by the blade 61, and an auger 63 for transferring the toner recovered in this recovery portion 62 in a predetermined direction. Furthermore, the charge removing device 7 and charging device 2 integrated by the image unit S are aligned to the drum surface of the photosensitive drum 1 via a predetermined spacing.

Hence, residual toner on the drum surface of the photosensitive drum 1*a* integrally held by the first image unit Sa is scraped off by the blade 61*a* integrally held by that unit Sa, residual charge on this drum surface is removed by the charge removing device 7*a*, and that drum surface is charged by the charging device 2*a*. Note that an electrostatic latent image formed on the drum surface of the first photosensitive drum 1*a* is developed by the solely mounted first developing device 4*a*.

Also, residual toner on the drum surface of the photosensitive drum 1*b* integrally held by the second image unit Sb is scraped off by the blade 61*b* integrally held by that unit Sb, residual charge on this drum surface is removed by the charge removing device 7*b*, and that drum surface is charged by the charging device 2*b*. An electrostatic latent image formed on the second photosensitive drum 1*b* is developed by the developing device 4*b* integrally held by the upstream neighboring image unit Sa.

Similarly, residual toner on the drum surface of the photosensitive drum 1*c* integrally held by the third image unit Sc is scraped off by the blade 61*c* integrally held by that unit Sc, residual charge on this drum surface is removed by the charge removing device 7*c*, and that drum surface is charged by the charging device 2*c*. An electrostatic latent image formed on the third photosensitive drum 1*c* is developed by the developing device 4*c* integrally held by the upstream neighboring image unit Sb.

Furthermore, residual toner on the drum surface of the fourth photosensitive drum 1*d* is cleaned by the solely mounted cleaning device 6*d*, residual charge on the drum surface of the fourth photosensitive drum 1*d* is removed by the solely mounted fourth charge removing device 7*d*, and that drum surface is charged by the solely mounted fourth charging device 2*d*. An electrostatic latent image formed on the fourth photosensitive drum 1*d* is developed by the developing device 4*d* which is integrally held by the third image unit Sc.

To restate, according to the image forming module A13 of this embodiment, since the first to third image units Sa to Sc integrally hold the downstream developing devices 4 and upstream cleaning devices 6, which neighbor each other, no extra frames between these developing devices 4 and cleaning devices 6 are required. In this embodiment, since most of constituent devices 1 to 7 are integrated as units, no work spaces required for individually attaching the constituent devices 1 to 7 are required, and the attachment spacings of the individual constituent devices can be reduced. With this arrangement, the length of the image forming module A13 in its longitudinal direction can be shortened, and the entire color copying machine can be made compact.

In this embodiment, since most of constituent devices that construct the image forming module A13 can be integrated, the number of processes required for assembling upon attaching the individual constituent devices to the image forming module of the copying machine can be reduced, and adjustment of the attachment positions of the respective constituent devices can be facilitated very much. Furthermore, since the image units Sa to Sd are used, labor required for managing the constituent devices 1 to 7 that build the image forming module A13 can be eliminated, and consequently, the manufacturing cost of the copying machine can be reduced.

Figure 26:
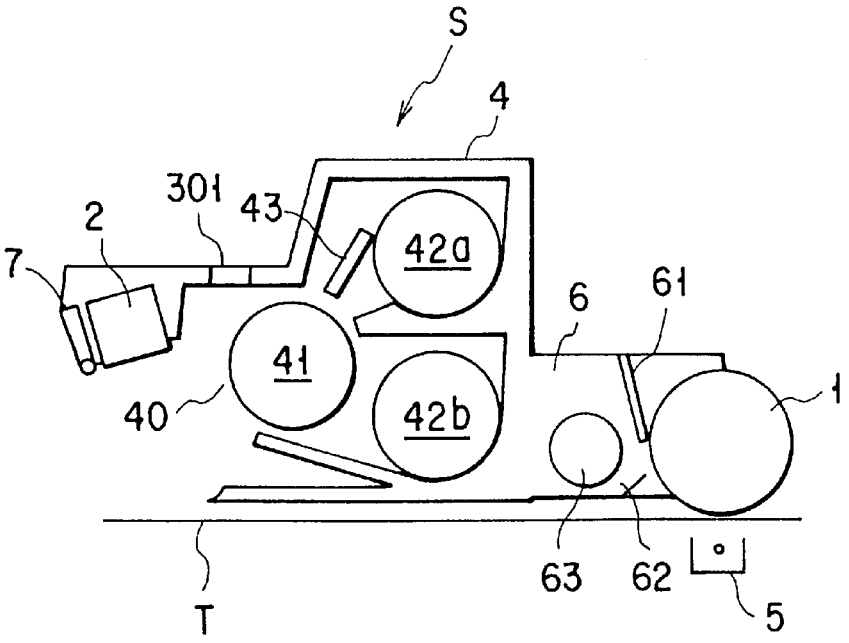
FIG. 26 is a schematic view showing an image unit attached to an image forming module according to the 14th embodiment of the present invention.

FIG. 26 shows the schematic arrangement of an image unit S built in an image forming module A14 according to the 14th embodiment of the present invention, as a modification of the image unit shown in FIG. 25.

This image unit S integrally holds a predetermined photosensitive drum 1, a cleaning device 6 which opposes the photosensitive drum 1, and a charge removing device 7, charging device 2, and developing device 4, which oppose a non-integrated photosensitive drum (not shown) that neighbors this photosensitive drum 1 on its downstream side.

The developing device 4 integrally held by this image unit S has an opening 40 opposing the downstream neighboring photosensitive drum. In this opening, a magnet roller 41 for supplying toner to the drum surface is rotatably arranged. Furthermore, the developing device 4 has a blade 43 which has a distal end that opposes the magnet roller 41 with a given spacing, and this blade 43 controls the thickness of the toner layer that becomes attached to the circumferential surface of the magnet roller 41.

On the other hand, the cleaning device 6 integrally held by this image unit S has a blade 61 which contacts the drum surface of the photosensitive drum 1 integrally held by the own unit at a predetermined pressure. The cleaning device 6 also has a recovery portion 62 for recovering toner scraped off by the blade 61, and an auger 63 for transferring the toner recovered in this recovery portion 62 in a predetermined direction. Furthermore, the charge removing device 7 and charging device 2 integrated by the image unit S are aligned to the downstream neighboring photosensitive drum, which is not integrated by this unit S, via a predetermined spacing. Note that a window 301 for guiding a laser beam onto the drum surface of the downstream neighboring photosensitive drum is formed on a predetermined portion of this image unit S.

Since the image unit S of this embodiment integrally holds the downstream developing device 4 and upstream cleaning device 6, which neighbor each other, no extra frames between these developing device 4 and cleaning device 6 are required. In this embodiment, when the image unit S of this embodiment is used, since most of constituent devices 1 to 7 of the image forming module A14 are integrated, no work spaces required for individually attaching the constituent devices 1 to 7 are required, and the attachment spacings of the individual constituent devices can be reduced. With this arrangement, the size of the image forming module A14 in its longitudinal direction can be shortened, and the entire color copying machine can be made compact.

In this embodiment, since most of constituent devices can be integrated by the image unit S, the number of processes required for assembling upon attaching the individual constituent devices to the image forming module of the copying machine can be reduced, and adjustment of the attachment positions of the respective constituent devices can be facilitated very much. Furthermore, since the image unit S of this embodiment is used, labor required for managing the constituent devices 1 to 7 that build the image forming module A14 can be eliminated, and consequently, the manufacturing cost of the copying machine can be reduced.

Note that the present invention is not limited to the aforementioned embodiments, and various changes and modifications may be made within the spirit and scope of the invention. For example, the arrangements of the above-mentioned embodiments can be appropriately combined.

What is claimed is:

1. An image forming apparatus comprising:

convey means for conveying a transfer medium in a predetermined direction;

a first image carrier provided along the convey means, for carrying a first latent image;

a second image carrier provided along the convey means on a downstream side in a convey direction of the transfer medium, and carrying a second latent image;

first and second developing devices for developing the first and second latent images by supplying developing agents, the first and second latent images respectively carried on said first and second image carriers;

first and second cleaning devices for respectively cleaning residual developing agents which remain on said first and second image carriers without being transferred onto the transfer medium; and an image unit provided between the first and second image carriers, for integrally holding said first cleaning device and said second developing device, wherein the image unit is detachably attached between the first image carrier and the second image carrier, the second developing device being located downstream of the first cleaning device with respect to said convey direction.

2. An image forming apparatus according to claim 1, further comprising a module for integrally holding the first image carrier, the second image carrier, and the image unit.

3. An image forming apparatus according to claim 2, wherein said image unit is detachable from said module.

4. An image unit detachably attached to an image forming apparatus, in which a plurality of image forming means, each of which has an image carrier that rotates along a convey direction of a transfer medium, electrostatic latent image forming means for forming an electrostatic latent image on a circumferential surface of said image carrier, a developing device for developing the electrostatic latent image by supplying a developing agent, a transfer device for transferring a developing agent image developed by said developing device onto the transfer medium conveyed in the convey direction, and a cleaning device including a blade for scraping off a residual developing agent which remains on the circumferential surface of said image carrier without being transferred by said transfer device, and a recovery portion for recovering scraped off residual developing agent, are juxtaposed in the convey direction, and which forms an image by sequentially transferring developing agent images formed by individual image forming means onto the transfer medium conveyed via these image forming means, wherein said image unit integrates the developing device in a predetermined image forming means, and the recovery portion of the cleaning device in the image forming means which neighbors the predetermined image forming means on an upstream side thereof, and wherein the image unit is detachably attached between the image carrier of the predetermined image forming means and the image carrier of the image forming means on the upstream side.

5. An image forming apparatus for forming a plurality of images on a plurality of image carriers and sequentially transferring the plurality of images onto a sheet medium being conveyed in a predetermined direction, thereby forming an image on the medium, the image forming apparatus comprising:

a module for holding the plurality of image carriers in a juxtaposed manner; and an image unit detachably provided between adjacent image carriers, the image unit integrating at least one component of a process unit for forming an image on an image carrier on an upstream side along a convey direction of the medium, and at least one component of a process unit for forming an image onto an image carrier on a downstream side along the convey direction.

6. An image forming apparatus according to claim 5, wherein a group of image units, each of which is equivalent to said image unit in function, are provided such that each one of the image units is provided between corresponding adjacent image carriers.

7. An image forming apparatus which comprises a plurality of image units and a plurality of image forming means juxtaposed in a convey direction, each of said plurality of image forming means having an image carrier that rotates along the convey direction of a transfer medium, electrostatic latent image forming means for forming an electrostatic latent image on a circumferential surface of said image carrier, a developing device for developing the electrostatic latent image by supplying a developing agent, a transfer device for transferring a developing agent image developed by said developing device onto the transfer medium conveyed in the convey direction, and a cleaning device for cleaning a residual developing agent which remains on the circumferential surface of said image carrier without being transferred by said transfer device, said image forming apparatus forming an image by sequentially transferring developing agent images formed by individual image forming means onto the transfer medium conveyed via these image forming means, wherein each of said plurality of image units integrates the developing device in a predetermined image forming means and the cleaning device in the image forming means which neighbors the predetermined image forming means on an upstream side thereof, and wherein the image unit is detachably attached between the image carrier of the predetermined image forming means and the image carrier of the image forming means on the upstream side.

* * * * *